US009052660B2

(12) United States Patent
Mine et al.

(10) Patent No.: US 9,052,660 B2
(45) Date of Patent: Jun. 9, 2015

(54) IMAGE FORMING APPARATUS DETECTING OCCURRENCE OF JAM

(71) Applicant: KONICA MINOLTA, INC., Chiyoda-ku (JP)

(72) Inventors: Hidenori Mine, Toyohashi (JP); Takahiro Tsujimoto, Toyokawa (JP); Masahiro Kamiya, Toyohashi (JP); Yutaka Yamamoto, Shinshiro (JP); Nobuhiro Matsuo, Toyokawa (JP); Seiichi Kirikubo, Toyohashi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/169,653

(22) Filed: Jan. 31, 2014

(65) Prior Publication Data

US 2014/0219668 A1 Aug. 7, 2014

(30) Foreign Application Priority Data

Feb. 1, 2013 (JP) ..... 2013-018143

(51) Int. Cl.
*G03G 15/00* (2006.01)
*G03G 21/00* (2006.01)
*B41J 29/38* (2006.01)

(52) U.S. Cl.
CPC ..... *G03G 15/5004* (2013.01); *G03G 15/70* (2013.01); *G03G 15/80* (2013.01)

(58) Field of Classification Search
CPC ... G03G 15/00; G03G 21/00; G03G 15/5004; G03G 15/70; G03G 15/80; B41J 29/38
USPC ..... 399/21
See application file for complete search history.

(56) References Cited

U.S. PATENT DOCUMENTS 3,213,349 A * 10/1965 Gutzwiller ..... 363/53
5,589,871 A 12/1996 Aoki et al.
7,675,255 B2 * 3/2010 Bates et al. ..... 318/375

(Continued)

FOREIGN PATENT DOCUMENTS

JP 56162757 A * 12/1981 ..... G03G 15/00
JP 63067767 A * 3/1988 ..... H01L 27/06

(Continued)

OTHER PUBLICATIONS

Notification of Reasons Refusal issued in corresponding Japanese Patent Application No. 2013-018143, mailed Mar. 3, 2015, with English translation thereof (14 pages).

*Primary Examiner* — Nguyen Ha
(74) *Attorney, Agent, or Firm* — Buchanan Ingersoll & Rooney PC

(57) ABSTRACT

An image forming apparatus includes a timing roller for conveying paper in the image forming apparatus, a first motor receiving supply of electric power from a power source for driving the timing roller, a second motor receiving supply of electric power from the power source, a sensor for detecting whether a jam occurs at the conveyance roller, a drive relay for cutting off supply of electric power from the power source to the first and second motors, if occurrence of a jam is detected, and a control circuit for controlling an operating state of the second motor such that regenerative power produced at the first motor due to rotation of the conveyance roller is supplied to the second motor, if occurrence of a jam is detected.

12 Claims, 16 Drawing Sheets

(56) References Cited

U.S. PATENT DOCUMENTS

| | | | | |
|---|---|---|---|---|
| 8,385,766 | B2 * | 2/2013 | Inukai | 399/88 |
| 2011/0187043 | A1 * | 8/2011 | Masuda et al. | 271/18.1 |

FOREIGN PATENT DOCUMENTS

| | | | | | |
|---|---|---|---|---|---|
| JP | 63081514 | A * | 4/1988 | | G05F 1/56 |
| JP | 06-219017 | | 8/1994 | | |
| JP | 2006208502 | A * | 8/2006 | | G03G 21/00 |
| JP | 2007-306673 | | 11/2007 | | |
| JP | 2008164999 | A * | 7/2008 | | G03G 21/00 |
| JP | 2008-199707 | A | 8/2008 | | |
| JP | 2010-028972 | A | 2/2010 | | |
| JP | 2010-081733 | | 4/2010 | | |
| JP | 2010-262123 | | 11/2010 | | |
| JP | 2011-103707 | A | 5/2011 | | |
| JP | 2011-145472 | | 7/2011 | | |
| JP | 2011-158743 | | 8/2011 | | |
| JP | 2012-078718 | | 4/2012 | | |

* cited by examiner

FIG.7

| SPEED OF PULLING OUT S | GROUPS OF THRESHOLD VALUES | THRESHOLD VALUES CONSTITUTING GROUP |
|---|---|---|
| $0<S\leqq S1$ | GROUP E1 | A1, B1, C1, D1 (A1<B1<C1<D1) |
| $S1<S\leqq S2$ | GROUP E2 | A2, B2, C2, D2 (A2<B2<C2<D2) |
| $S2<S\leqq S3$ | GROUP E3 | A3, B3, C3, D3 (A3<B3<C3<D3) |
| $S3<S\leqq S4$ | GROUP E4 | A4, B4, C4, D4 (A4<B4<C4<D4) |

S1<S2<S3<S4, A4<A3<A2<A1, B4<B3<B2<B1, C4<C3<C2<C1, D4<D3<D2<D1

FIG.9

| RANGES TO WHICH INCREASE RATE (ΔV/ΔT) OF BACK ELECTROMOTIVE FORCE BELONGS | SELECTED LOADS |
|---|---|
| RG1(0<ΔV/ΔT≦THRESHOLD VALUE A) | NO LOADS |
| RG2(THRESHOLD VALUE A<ΔV/ΔT≦THRESHOLD VALUE B) | G1 |
| RG3(THRESHOLD VALUE B<ΔV/ΔT≦THRESHOLD VALUE C) | G1, G2 |
| RG4(THRESHOLD VALUE C<ΔV/ΔT≦THRESHOLD VALUE D) | G1, G2, G3 |
| RG5(THRESHOLD VALUE D<ΔV/ΔT) | G1, G2, G3, G4 |

FIG.10

GROUPS CONSUMING POWER

COUPLING OF MOTOR WITH ROLLER IS RELEASED BY DISENGAGING CLUTCH WHEN JAM IS DETECTED

COUPLING OF MOTOR WITH ROLLER IS RELEASED WHEN PAPER FEED TRAY IS PULLED OUT DURING JAM HANDLING

COUPLING STATE OF LOAD AND ROLLER WHEN JAM OCCURS

STATE OF LOAD WHEN PAPER IS PULLED OUT

SECONDARY TRANSFER ROLLER CONNECTING/ DISCONNECTING MOTOR

ALWAYS COUPLED. WHEN DOOR IS OPENED IN JAM HANDLING, CRIMPING ROLLER IS SEPARATED FROM CONVEYANCE ROLLER (NIP PRESSURE DECREASES)

COUPLING STATE CANNOT BE ESTIMATED BECAUSE TARGET LOAD TO BE DRIVEN IS NON-ROTATING LOAD

| | LOADS (DRIVING SOURCES) | | | | PRIORITY (USER'S SAFETY) |
|---|---|---|---|---|---|
| G1 | 1ST-STAGE PAPER FEED MOTOR AND LIFT-UP MOTOR | | NO ROTATES | A | |
| | 2ND-STAGE PAPER FEED MOTOR AND LIFT-UP MOTOR | | | | |
| | 3RD-STAGE PAPER FEED MOTOR AND LIFT-UP MOTOR | | | | |
| | 4TH-STAGE PAPER FEED MOTOR AND LIFT-UP MOTOR | | | | |
| G2 | TIMING MOTOR | ALWAYS COUPLED | ROTATES | B | SOME ROLLERS ARE SAFE EVEN WHEN RUNNING DEPENDING ON PAPER CONVEYANCE PATH |
| | PAPER DISCHARGE MOTOR | | | | |
| | REVERSE MOTOR | | | | |
| | ADU CONVEYANCE MOTOR | | | | |
| | MANUAL PAPER FEED MOTOR AND LIFTING MOTOR | | | | |
| | LCT MOTOR | | | | |
| G3 | LCC INTERMEDIATE MOTOR | | ROTATES WHEN PAPER EXISTS | C | |
| | LONGITUDINAL CONVEYANCE MOTOR | | | | |
| | | | | | |
| | FIXING MOTOR | | | | |
| G4 | CLUTCH | | OUT OF ESTIMATION | D | |
| | SOLENOID | | | | |
| | ERASER | | | | |
| | POWER STORAGE ELEMENT | | | | |
| | DRIVE SOURCE FOR IMAGING SYSTEM | | | | |
| | DRIVE SOURCE FOR COOLING SYSTEM | | | | |

PRIORITY A: HIGHEST PRIORITY, B: HIGH PRIORITY, C: LOW PRIORITY, D: LOWESTPRIORITY

FIG.16

| RANGES TO WHICH BACK ELECTROMOTIVE FORCE (V) BELONGS | SELECTED LOADS |
|---|---|
| RG1(0<V≦THRESHOLD VALUE V1) | NO LOADS |
| RG2(THRESHOLD VALUE V1<V≦THRESHOLD VALUE V2) | G1 |
| RG3(THRESHOLD VALUE V2<V≦THRESHOLD VALUE V3) | G1, G2 |
| RG4(THRESHOLD VALUE V3<V≦THRESHOLD VALUE V4) | G1, G2, G3 |
| RG5(THRESHOLD VALUE V4<V) | G1, G2, G3, G4 |

V1<V2<V3<V4

IMAGE FORMING APPARATUS DETECTING OCCURRENCE OF JAM

This application is based on Japanese Patent Application No. 2013-018143 filed with the Japan Patent Office on Feb. 1, 2013, the entire content of which is hereby incorporated by reference.

BACKGROUND OF THE INVENTION

1. Field of the Invention

The present invention relates to an image forming apparatus that detects occurrence of a jam, and more particularly to an image forming apparatus having a conveyance roller for conveying paper.

2. Description of the Related Art

Electrophotographic image forming apparatuses include MFPs (Multi-Functional Peripherals) having scanner, facsimile, copy, printer, data communication, and server functions, facsimile machines, copiers, and printers.

In an image forming apparatus, when a jam (paper jam) occurs, the user of the image forming apparatus opens the door of the casing of the image forming apparatus and removes paper that causes the jam in order to clear the jam. In general, paper that causes a jam (hereinafter also called jammed paper) is sandwiched between rollers for conveying paper in the inside of the image forming apparatus. The user pulls out the jammed paper from between the rollers thereby clearing the jam. This process is called jam handling.

In jam handling, the force exerted by the user to pull out jammed paper rotates the roller, whereby a motor coupled to the roller is rotated. The rotation of the motor produces regenerative power (regenerative energy by self-power generation of the motor). Back electromotive force (back electromotive voltage) of this regenerative power may break down a load (device) in the image forming apparatus that is connected to the same power system as the motor.

Document 1 below discloses a technique for protecting a load from back electromotive force. According to this technique, if external force rotates a motor, a motor control device decelerates the rotation of the motor thereby preventing overvoltage due to induced voltage.

Document 1: Japanese Laid-Open Patent Publication No. 2011-103707

In order to prevent accidental rotation of the motor and to ensure the user's safety, power supply from the power source to the motor is preferably cut off. In the technique in Document 1, however, it is impossible to cut off power supply from the power source to the motor because it is necessary to supply power to the motor in order to decelerate the rotation of the motor.

SUMMARY OF THE INVENTION

An object of the present invention is to provide an image forming apparatus capable of properly protecting a load in the image forming apparatus.

According to an aspect of the present invention, an image forming apparatus includes: a plurality of loads receiving supply of electric power from a power source; a conveyance roller for conveying paper; a first load that is one of the plurality of loads for driving the conveyance roller; a second load that is one of the plurality of loads and different from the first load; a jam detector for detecting whether a jam occurs at the conveyance roller; a first power cut-off unit for cutting off supply of electric power from the power source to the plurality of loads, if the jam detector detects occurrence of a jam; and a power supply unit for controlling an operating state of the second load such that regenerative power produced at the first load due to rotation of the conveyance roller is supplied to the second load, if the jam detector detects occurrence of a jam.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 7 is a table showing the relationship between the speed of pulling out jammed paper and threshold values for the increase rate of back electromotive force.

FIG. 9 is a table showing the relationship between ranges to which the increase rate of back electromotive force belongs and the selected loads.

FIG. 10 is a table schematically showing loads belonging to each of consumption groups G1 to G4.

FIG. 16 is a table showing the relationship between the magnitude of back electromotive force and the selected load in a modified method of selecting a load to be supplied with regenerative power.

DESCRIPTION OF THE PREFERRED EMBODIMENTS

An embodiment of the present invention will be described below with reference to the figures.

In the present embodiment, the image forming apparatus includes an MFP (Multi-Functional Peripheral), a facsimile machine, a copier, a printer, or the like.

[Configuration of Image Forming Apparatus]

First, a configuration of the image forming apparatus in the present embodiment will be described.

Figure 1:
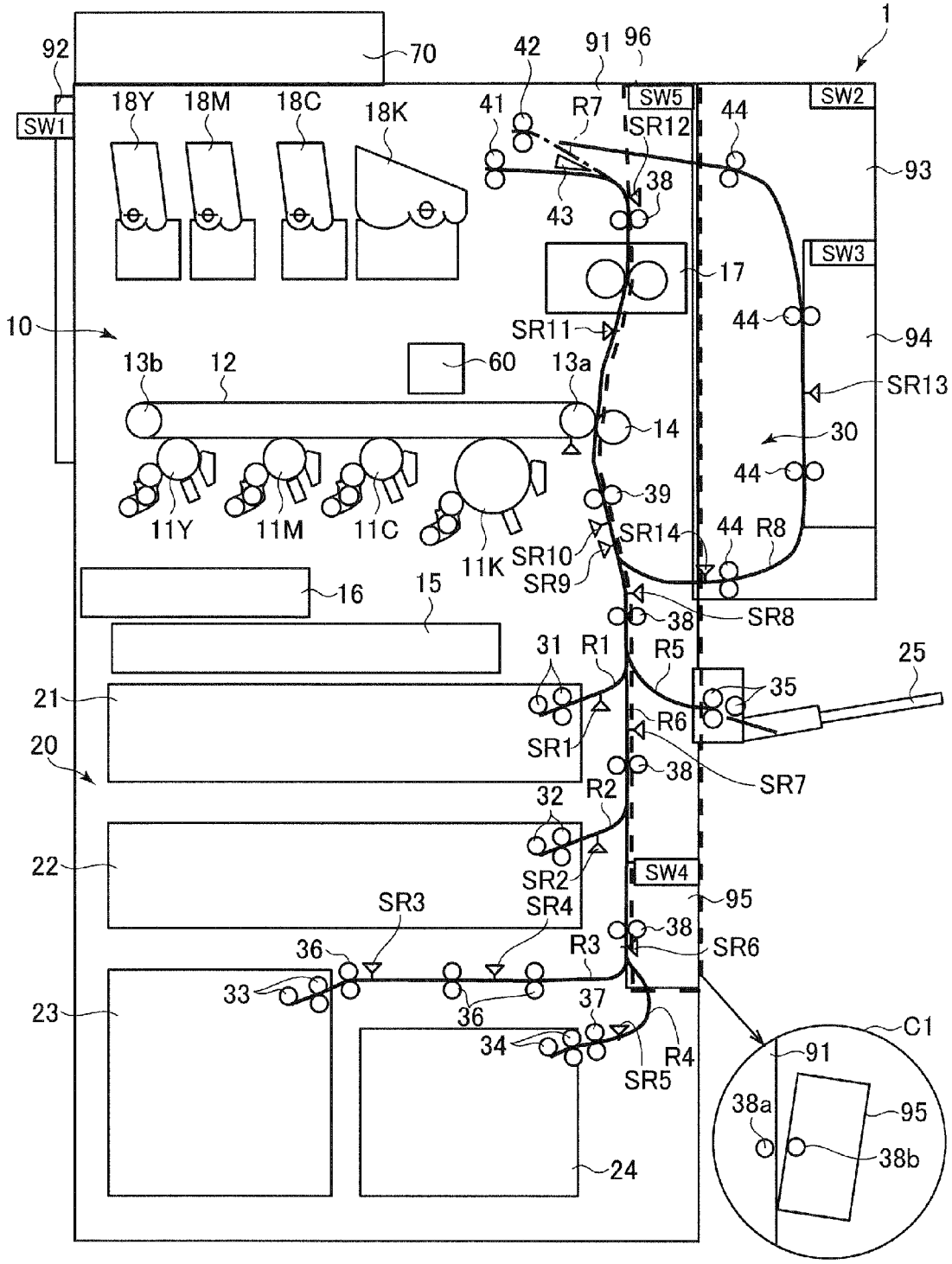
FIG. 1 is a cross-sectional view schematically showing a configuration of an image forming apparatus.

Referring to FIG. 1, an image forming apparatus 1 is here a printer and includes an image forming unit 10, a paper feed unit 20, a paper conveyor unit 30, a control unit 60, and an operation panel 70. Image forming apparatus 1 may further include a scanner for scanning an image.

Paper feed unit 20 is a unit for accommodating and feeding paper, and includes a first tray 21, a second tray 22, a third tray 23, a fourth tray 24, and a fifth tray 25. First tray 21 is provided at the top of paper feed unit 20. Second tray 22 is provided under first tray 21. Third and fourth trays 23 and 24 are provided side by side under second tray 22. Fifth tray 25 is a tray for manually feeding paper and protrudes outward from image forming apparatus body 91.

Each of first to fourth trays 21 to 24 accommodates paper. The orientations or sizes of stored paper differs among first to fourth trays 21 to 24. The user stores paper in a tray or clears a jam occurred in a tray by pulling out one of the first to fourth trays 21 to 24 toward the front in FIG. 1. The user arranges paper of a special size in fifth tray 25, as necessary. Paper feed unit 20 may further include an LCT (Large Capacity Tray).

Image forming unit 10 is a unit for forming an image on paper and includes imaging units 11Y, 11M, 11C, and 11K, an intermediate transfer belt 12, a driving roller 13*a* and a driven roller 13*b*, a secondary transfer roller 14, an exposure device 15, a waste toner box 16, a fixing unit 17, and toner bottles 18Y, 18M, 18C, and 18K.

Intermediate transfer belt 12 is an annular belt. Intermediate transfer belt 12 is suspended approximately horizontally between driving roller 13*a* and driven roller 13*b*. Intermediate transfer belt 12 is rotated by the driving force of driving roller 13*a*.

During execution of the print function, imaging units 11Y, 11M, 11C, and 11K form yellow (Y), magenta (M), cyan (C), and black (K) toner images, respectively, on intermediate transfer belt 12. Imaging units 11Y, 11M, 11C, and 11K are arranged below intermediate transfer belt 12 in this order along the rotating direction of intermediate transfer belt 12. The toner images created by imaging units 11Y, 11M, 11C, and 11K are superimposed on each other on intermediate transfer belt 12, whereby a color toner image is formed on intermediate transfer belt 12. This toner image is transferred by secondary transfer roller 14 onto paper conveyed along a conveyance path R6, at the conveyance end (driving roller 13*a*) at the right end in FIG. 1 of intermediate transfer belt 12.

Imaging units 11Y, 11M, 11C, and 11K each form a toner image by electrostatography. Each of imaging units 11Y, 11M, 11C, and 11K mainly includes a photoconductor, a developing unit for developing an electrostatic latent image formed on the surface of the photoconductor, a charger for charging the surface of the photoconductor, and a primary transfer roller for transferring a toner image formed on the surface of the photoconductor onto intermediate transfer belt 12.

Exposure device 15 forms an electrostatic latent image on the surface of the photoconductor by applying laser light to the surface of the charged conductor in each of imaging units 11Y, 11M, 11C, and 11K.

Waste toner box 16 stores waste toner recovered from intermediate transfer belt 12 and the photoconductors.

Fixing unit 17 includes a heating roller and a pressing roller. Paper having a toner image transferred thereon is sent to fixing unit 17 and is heated and pressed by fixing unit 17. Accordingly, a color image is formed on paper.

Toner bottles 18Y, 18M, 18C, and 18K are provided above intermediate transfer belt 12. Toner bottles 18Y, 18M, 18C, and 18K store Y, M, C, and K toners, respectively. Tonner bottles 18Y, 18M, 18C, and 18K each are rotatably driven to replenish the respective development units of imaging units 11Y, 11M, 11C, and 11K with toner stored therein. The toner replenishment operation is performed when toner in each development unit decreases.

Paper conveyor unit 30 is a unit for conveying paper in image forming apparatus 1 and includes paper feed rollers 31 to 35, conveyance rollers 36 to 38 and 44, a timing roller 39, a paper discharge roller 41, a reverse roller 42, and a switch gate 43.

Paper feed roller 31 is provided on a conveyance path R1 and conveys paper stored in first tray 21 to conveyance path R6. Paper feed roller 32 is provided on a conveyance path R2 and conveys paper stored in second tray 22 to conveyance path R6. Paper feed roller 33 and conveyance roller 36 are provided on a conveyance path R3 and convey paper stored in third tray 23 to conveyance path R6. Paper feed roller 34 and conveyance roller 37 are provided on a conveyance path R4 and convey paper stored in fourth tray 24 to conveyance path R6. Paper feed roller 35 is provided on a conveyance path R5 and conveys paper arranged in fifth tray 25 to conveyance path R6.

Figure 2:
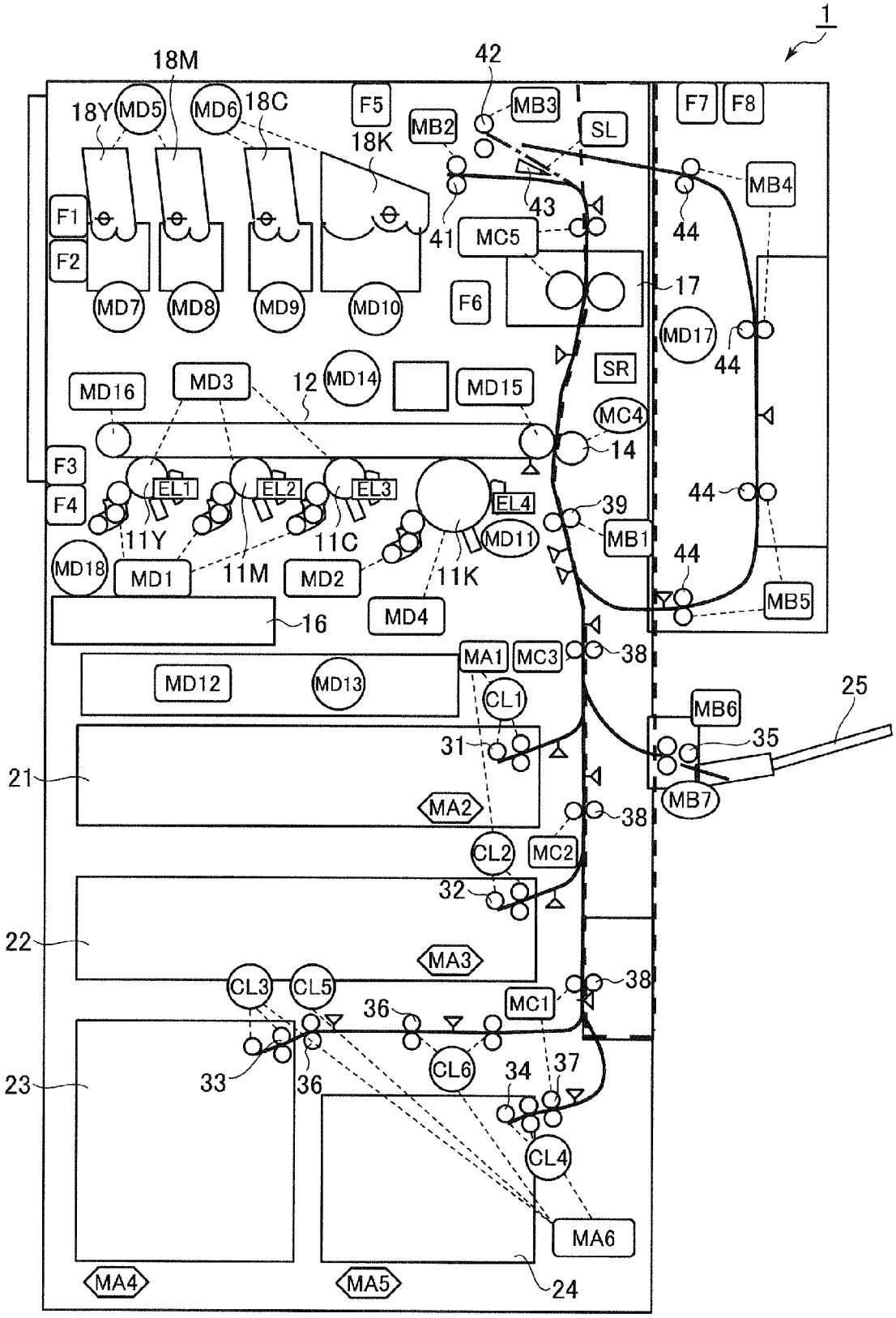
FIG. 2 is a cross-sectional view schematically showing loads provided in the image forming apparatus shown in FIG. 1 and a configuration associated with the loads.

Conveyance roller 38 is provided on conveyance path R6 and conveys paper fed from each tray upward in FIG. 2 along conveyance path R6.

Timing roller 39 is provided upstream (the lower side in FIG. 1) of secondary transfer roller 14 in conveyance path R6. Timing roller 39 temporarily stops paper conveyed through conveyance path R6 and conveys the paper to secondary transfer roller 14 at a predetermined timing.

Conveyance path R6 branches to a conveyance path R7 downstream from fixing unit 17. Paper discharge roller 41 is provided at the most downstream side of conveyance path R6. Reverse roller 42 is provided at the most downstream side of conveyance path R7. Switch gate 43 is provided at the branch between conveyance paths R6 and R7. Conveyance roller 44 is provided on an annular conveyance path R8.

In a case of single-sided printing, paper having an image formed thereon is conveyed to the most downstream side of conveyance path R6 by switch gate 43 and discharged to the outside of image forming apparatus 1 by paper discharge roller 41. In a case of duplex printing, paper having an image formed thereon on either side is conveyed to conveyance path R7 by switch gate 43. Paper conveyed to conveyance path R7 is switched back by reverse roller 42 and conveyed to conveyance path R8. The paper is conveyed through conveyance path R8 by conveyance roller 44 and conveyed to conveyance path R6 again, and has an image formed on another surface. The paper is then discharged to the outside of image forming apparatus 1 by paper discharge roller 41.

Image forming apparatus body 91 has doors 92 to 96 (door 96 is shown by a dotted line). When a jam occurs, the user opens an appropriate one of doors 92 to 96 to expose a conveyance path thereby clearing the jam occurring at a roller on the conveyance path. Doors 92 to 96 have door switches SW1 to SW5, respectively, for detecting the open/closed state of doors 92 to 96.

A sensor SR1 for detecting paper is provided on conveyance path R1. A sensor SR2 for detecting paper is provided on conveyance path R2. Sensors SR3 and SR4 for detecting paper are provided on conveyance path R3. A sensor SR5 for detecting paper is provided on conveyance path R4. Sensors SR6 to SR12 for detecting paper are provided on conveyance path R6. A sensor SR13 for detecting paper is provided on conveyance path R8. Based on the detection result of each of sensors SR1 to SR13, image forming apparatus 1 can detect whether a jam occurs at the location of each sensor.

Control unit 60 controls operation of image forming apparatus 1.

Operation panel 70 displays a variety of information to the user and accepts an operation on image forming apparatus 1 from the user.

The opened door 95 is shown in a circle C1 in FIG. 1. As shown in circle C1, conveyance roller 38 is present in the vicinity of door 95. Conveyance roller 38 is configured to include a driving roller 38*a* and a driven roller 38*b*. Driving roller 38*a* is provided in the inside of image forming apparatus body 91, and driven roller 38*b* is provided in the outside of image forming apparatus body 91. When the user opens door 95, driven roller 38*b* moves outward of image forming apparatus 1 together with door 95. As a result, driven roller 38*b* is separated from driving roller 38*a*. Accordingly, when a jam occurs in conveyance roller 38, the user can perform jam handling.

Likewise, when door 94 is opened, the driving roller and the driven roller are separated from each other in conveyance rollers 44 at two places. When door 96 is opened, the driving roller and the driven roller are separated from each other at conveyance rollers 38 at four places and at timing roller 39.

FIG. 2 is a cross-sectional view schematically showing loads provided in the image forming apparatus shown in FIG. 1 and a configuration associated with the loads.

Referring to FIG. 2, image forming apparatus 1 includes, as a plurality of loads (driving sources) receiving power supply from a power source, motors MA1 to MA6, MB1 to MB7, MC1 to MC5, and MD1 to MD18, fan motors F1 to F8, erasers EL1 to EL4, and a solenoid SL.

Motor MA1 is a paper feed motor and drives each of paper feed rollers 31 and 32. Clutches CL1 and CL2 transmit or cut off the rotational force of motor MA1 to/from paper feed rollers 31 and 32, respectively, by coupling or disconnecting motor MA1 with paper feed rollers 31 and 32, respectively.

Motors MA2 to MA5 are lift-up motors and lift up paper stored in first to fourth trays 21 to 24, respectively.

Motor MA6 is an LCC (Large Capacity Cassette) motor and drives paper feed rollers 33 and 34 and conveyance rollers 36 and 37. Clutches CL3 and CL4 transmit or cut off the rotational force of motor MA6 to/from paper feed rollers 33 and 34, respectively, by coupling or disconnecting motor MA6 with paper feed rollers 33 and 34, respectively. Clutches CL5 and CL6 transmit or cut off the rotational force of motor MA6 to/from conveyance roller 36 by coupling or disconnecting motor MA6 with conveyance roller 36.

Motor MB1 is a timing motor and drives timing roller 39. Motor MB2 is a paper discharge motor and drives paper discharge roller 41. Motor MB3 is a reverse motor and drives reverse roller 42. Motors MB4 and MB5 are ADU (Auto Duplex Unit) conveyance motors and drive conveyance roller 44. Motor MB6 is a manual paper feed motor and drives paper feed roller 35. Motor MB7 is a lifting motor and lifts a guide for feeding paper arranged on fifth tray 25.

Motors MC1 to MC3 are an LCC intermediate motor, a first longitudinal conveyance motor, and a second longitudinal conveyance motor, respectively, and drive conveyance rollers 37 and 38. Motor MC4 is a secondary transfer roller connecting/disconnecting motor and controls the contact state between secondary transfer roller 14 and intermediate transfer belt 12 by moving secondary transfer roller 14. Motor MC5 is a fixing motor and drives the pressing roller or the heating roller of fixing unit 17.

Motor MD1 is a development motor for YMC and drives the development unit of each of imaging units 11Y, 11M, and 11C. Motor MD2 is a development motor for K and drives the development unit of imaging unit 11K. Motor MD3 is a photoconductor motor for YMC and drives the photoconductor of each of imaging units 11Y, 11M, and 11C. Motor MD4 is a photoconductor motor for K and drives the photoconductor of imaging unit 11K. Motor MD5 is a cartridge motor for YM and drives toner bottles 18Y and 18M. Motor MD6 is a cartridge motor for CK and drives toner bottles 18C and 18K. Motors MD7 to MD10 are toner replenishment motors and supplies power to replenish imaging units 11Y, 11M, 11C, and 11K, respectively, with toner.

Motor MD11 is a charge cleaning motor and drives a cleaning device for the photoconductor. Motors MD12 and MD13 are a polygon motor and a skew motor, respectively, and drive a polygon mirror and a skew unit in exposure device 15. Motor MD14 is a primary transfer roller connecting/disconnecting motor and controls the contact state between the primary transfer roller and intermediate transfer belt 12 by moving the primary transfer roller. Motor MD15 is an intermediate transfer belt motor and drives intermediate transfer belt 12. Motor MD16 is a cleaner brush motor and drives a cleaner brush for removing waste toner on intermediate transfer belt 12. Motor MD17 is a fixing roller connecting/disconnecting motor and drives the heating roller (fixing roller) of fixing unit 17. Motor MD18 is a waste toner conveyance motor and drives a member for conveying waste toner recovered from intermediate transfer belt 12 and the photoconductors to waste toner box 16.

Fan motors F1 to F8 are motors for driving a toner bottle cooling fan, a toner suction fun, an imaging unit cooling fan, a print head cooling fan, an IH (Induction Heating) power source cooling fan, a paper cooling fan, an ozone exhaust fan, and a paper cooling fan, respectively.

Erasers EL1 to EL4 erase the potential on the surfaces of the respective photoconductors of imaging units 11Y, 11M, 11C, and 11K, respectively.

Solenoid SL drives switch gate 43.

Image forming apparatus 1 may include any other load in addition to the above-noted loads or may include only some of the above-noted loads.

Figure 3:
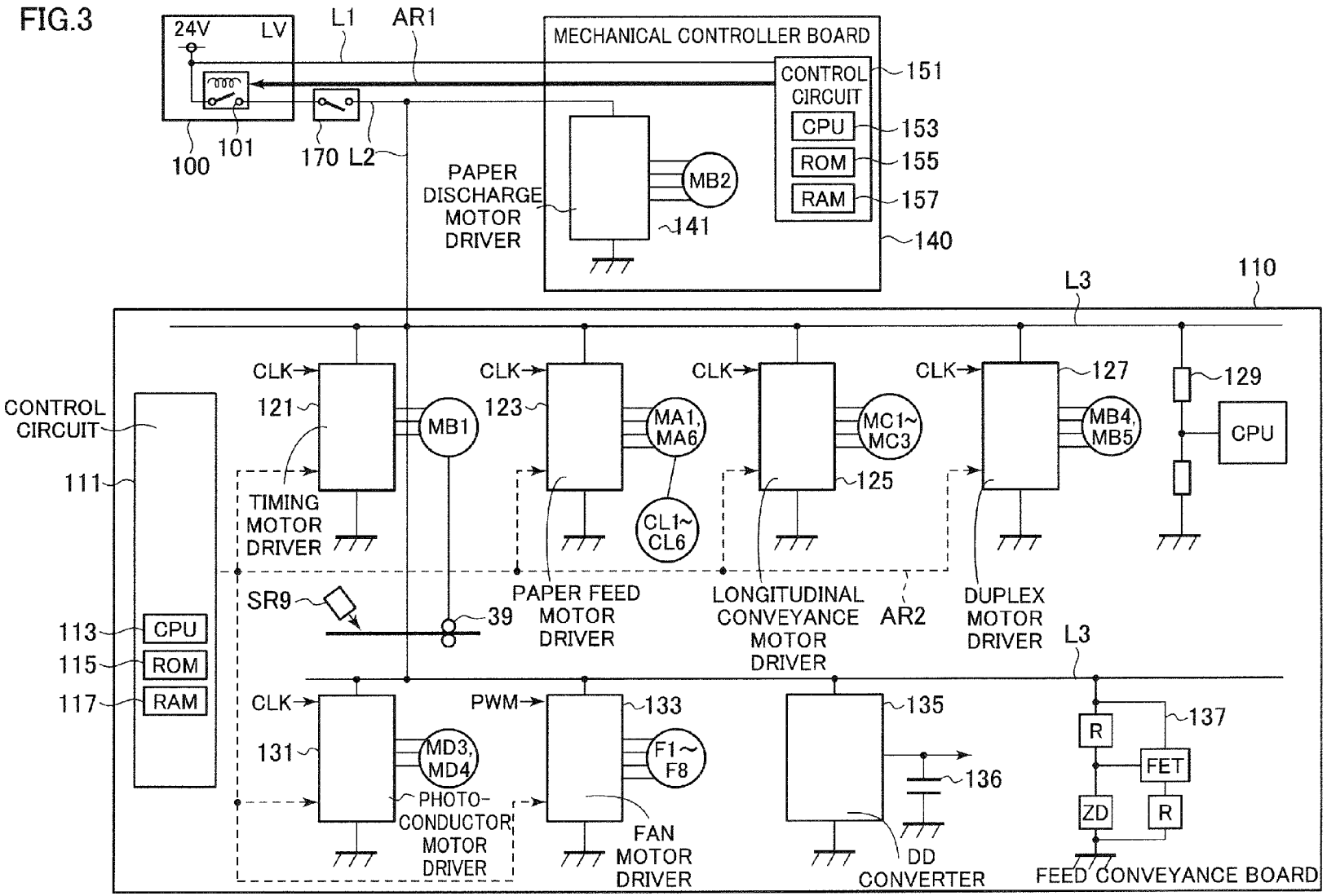
FIG. 3 is a block diagram schematically showing a circuit configuration of a control unit.

FIG. 3 is a block diagram schematically showing a circuit configuration of the control unit.

Referring to FIG. 3, control unit 60 of image forming apparatus 1 includes a power source 100 that is an LV (Low Voltage) power source, a feed conveyance board 110, and a mechanical controller board 140. Power source 100, feed conveyance board 110, and mechanical controller board 140 are electrically connected with each other. In particular, power source 100 and feed conveyance board 110 are connected through a door switch 170. Door switch 170 is a member corresponding to door switches SW1 to SW5 in FIG. 1.

Power source 100 converts a voltage of electric power from a commercial power supply to a low voltage, for example, 24 V, and supplies electric power at 24V (24 V power) to feed conveyance board 110 and mechanical controller board 140. Power source 100 includes a drive relay 101 for switching whether to supply 24 V power to feed conveyance board 110, mechanical controller board 140, and a plurality of loads.

Feed conveyance board 110 controls paper feed and conveyance in image forming apparatus 1. Feed conveyance board 110 includes a control circuit 111, a timing motor driver (drive element) 121, a paper feed motor driver 123, a longitudinal conveyance motor driver 125, a duplex motor driver 127, a voltage dividing circuit 129, a photoconductor motor driver 131, a fan motor driver 133, a DD converter (DC (Direct Current)/DC converter) 135, and a resistor circuit 137.

Timing motor driver 121, paper feed motor driver 123, longitudinal conveyance motor driver 125, duplex motor driver 127, photoconductor motor driver 131, and fan motor driver 133 may hereinafter collectively be referred to as feed conveyance drivers, and the loads driven by the feed/conveyance drivers may be referred to as feed conveyance loads. Feed conveyance board 110 may include, in addition to the drivers shown in FIG. 3, a driver for a member that feeds and conveys paper.

Control circuit 111, the feed conveyance drivers, voltage driving circuit 129, DD converter 135, and resistor circuit 137 are connected with each other through a line L3. Line L3 is connected with a line L2 (24V-21 line). Control circuit 111, the feed conveyance drivers, voltage diving circuit 129, DD converter 135, and resistor circuit 137 are connected with drive relay 101 through lines L2 and L3. Door switch 170 is provided between feed conveyance board 110 and drive relay 101. Feed conveyance board 110 supplies power from power source 100 via drive relay 101 and door switch 170 to each feed conveyance load.

Control circuit 111 includes a CPU (Central Processing Unit) 113, a ROM (Read Only Memory) 115, and a RAM (Random Access Memory) 117. CPU 113 executes a control program stored in ROM 115. ROM 115 stores the control program controlling operation of CPU 113. RAM 117 is a working memory for CPU 113.

Timing motor driver 121 controls operation of motor MB1 that is a timing motor. Paper feed motor driver 123 controls operation of motors MA1 and MA6 that are paper feed motors. Longitudinal conveyance motor driver 125 controls operation of motors MC1 to MC3 that are the LCC intermediate motor, the first longitudinal conveyance motor, and the second longitudinal conveyance motor, respectively. Duplex motor driver 127 controls operation of motors MB4 and MB5 that are ADU conveyance motors. When regenerative energy is produced in any one of the feed conveyance loads, voltage dividing circuit 129 measures back electromotive force by the regenerative power and transmits the measured voltage value to control circuit 111. Triggered by back electromotive force exceeding a certain threshold value or by detection of rotation of a conveyance motor by a sensor, voltage dividing circuit 129 starts measurement of back electromotive force and measures back electromotive force at regular time intervals (for example, every few tens of μs) until the back electromotive force becomes zero. Photoconductor (PC) motor driver 131 controls operation of motors MD3 and MD4 that are the photoconductor motor for YMC and the photoconductor motor for K, respectively. Fan motor driver 133 controls operation of fan motors F1 to F8.

Control circuit 111 transmits an enable signal (a control signal that enables operation of a load) to each of the feed conveyance drivers as drive elements (to turn on the enable signal for each load), as shown by an arrow AR2, thereby bringing each feed conveyance load into an operative state (conductive state). Control circuit 111 also transmits a clock signal (CLK) (PWM (Pulse Width Modulation) for fan motors F1 to F8 to each of the feed conveyance drivers, thereby actually rotating the feed conveyance load.

Mechanical controller board 140 controls operation of an engine unit that performs an image forming operation. Mechanical controller board 140 mainly includes a control circuit 151 and a paper discharge motor driver 141. Control circuit 151 is connected with power source 100 through a line L1 (24 V-16 line). Control circuit 151 transmits a signal to drive relay 101 as shown by an arrow AR1, for example, when a jam is detected, thereby controlling on/off of drive relay 101.

Control circuit 151 includes a CPU 153, a ROM 155, and a RAM 157. CPU 153 executes a control program stored in ROM 155. ROM 155 stores the control program controlling operation of CPU 153. RAM 157 is a working memory for CPU 153.

Paper discharge motor driver 141 is connected with drive relay 101 through line L2. Door switch 170 is provided between paper discharge motor driver 141 and drive relay 101. Paper discharge motor 141 controls operation of motor MB2 that is the paper discharge motor. Motor MB2 is a load having a minimum withstand voltage among all the loads in image forming apparatus 1 (the withstand voltage of motor MB2 may hereinafter be called the minimum withstand voltage).

Mechanical controller board 140 may include a driver, other than paper discharge motor driver 141, for a member performing image forming.

[Principle by which Load in Image Forming Apparatus is Broken]

The principle by which a load in the image forming apparatus is broken by back electromotive force of regenerative power will now be described in details.

Figure 4:
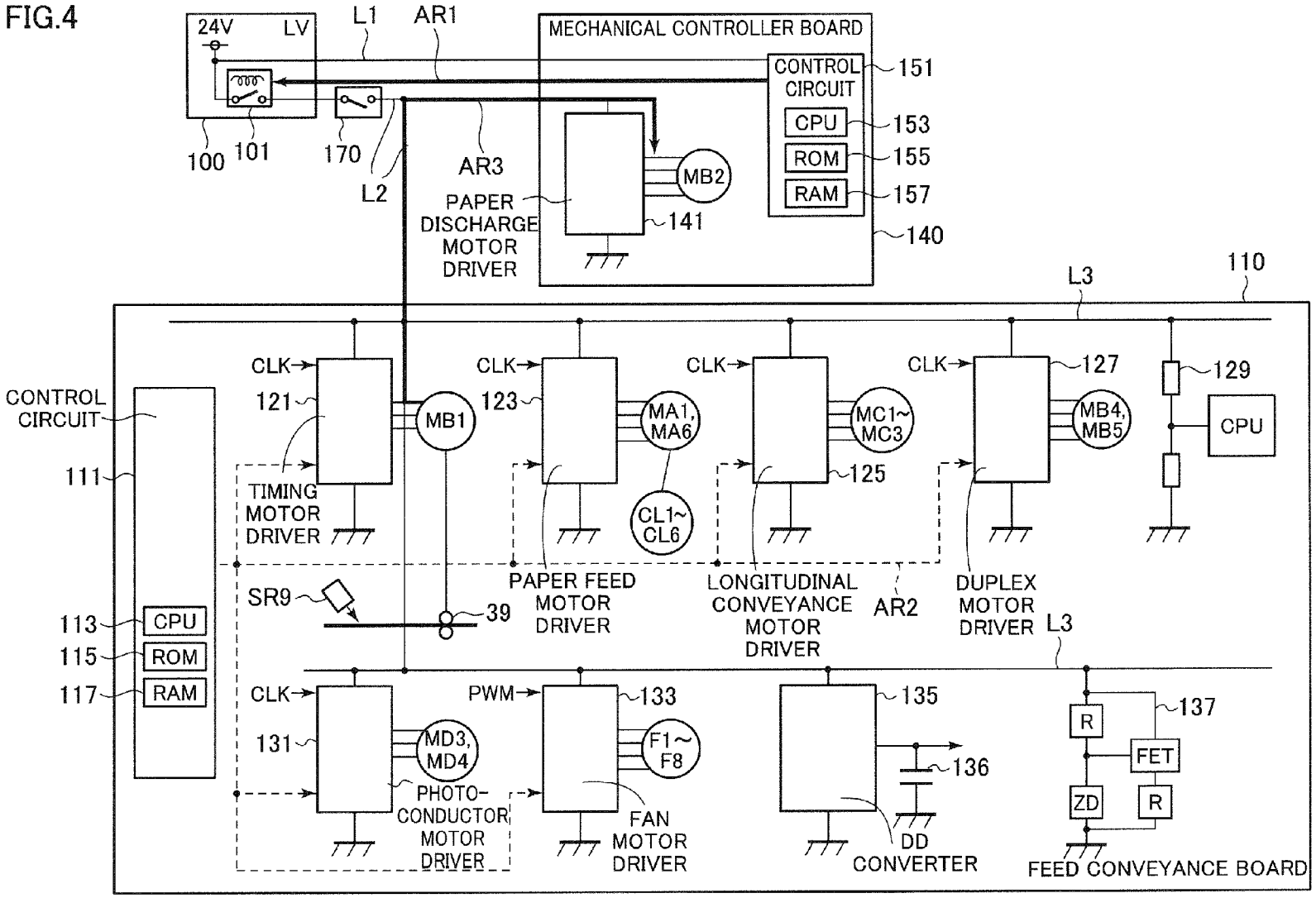
FIG. 4 is a diagram schematically showing a principle by which a load in the image forming apparatus is broken by back electromotive force of regenerative power.

FIG. 4 is a diagram schematically showing a principle by which a load in the image forming apparatus is broken by back electromotive force of regenerative power. In the following description, it is assumed that a jam occurs at timing roller 39 (jammed paper remains on the conveyance path in the vicinity of timing roller 39).

Referring to FIG. 4, when a jam occurs at timing roller 39, sensor SR9 for detecting paper in the vicinity of timing roller 39 detects the jammed paper. If sensor SR9 keeps detecting paper for a certain period of time or longer, CPU 113 detects that a jam occurs at timing roller 39 and notifies the user of occurrence of the jam, for example, by indicating occurrence of a jam on operation panel 70 (FIG. 1). When CPU 113 detects occurrence of a jam, CPU 153 of mechanical controller board 140 turns off drive relay 101. As a result, power supply from power source 100 to each load under driver relay 101 is cut off.

In order to perform jam handling, the user opens the door where timing roller 39 is provided (door 96 shown in FIG. 1). As a result, door (longitudinal door) switch 170 is rendered nonconductive, and line L2 under door switch 170 is cut off from power source 100.

The user then performs jam handling by pulling out the jammed paper from timing roller 39. The force exerted when the user pulls out the jammed paper rotates timing roller 39, so that motor MB1 (timing motor) coupled to timing roller 39 through gears self-generates power to produce regenerative power. Back electromotive force of this regenerative power is applied to motor MB2 (paper discharge motor) having the lowest withstand voltage (hereinafter also called a minimum withstand voltage) among the loads connected to the same power supply system (line L3) via timing motor driver 121, line L3, and line L2, as shown by arrow AR3. As a result, back electromotive force exceeding the withstand voltage is applied to motor MB2, whereby motor MB2 is broken.

[Operation of Image Forming Apparatus]

In order to prevent breakage of motor MB2 as described above, the image forming apparatus in the present embodiment operates as follows.

Figure 5:
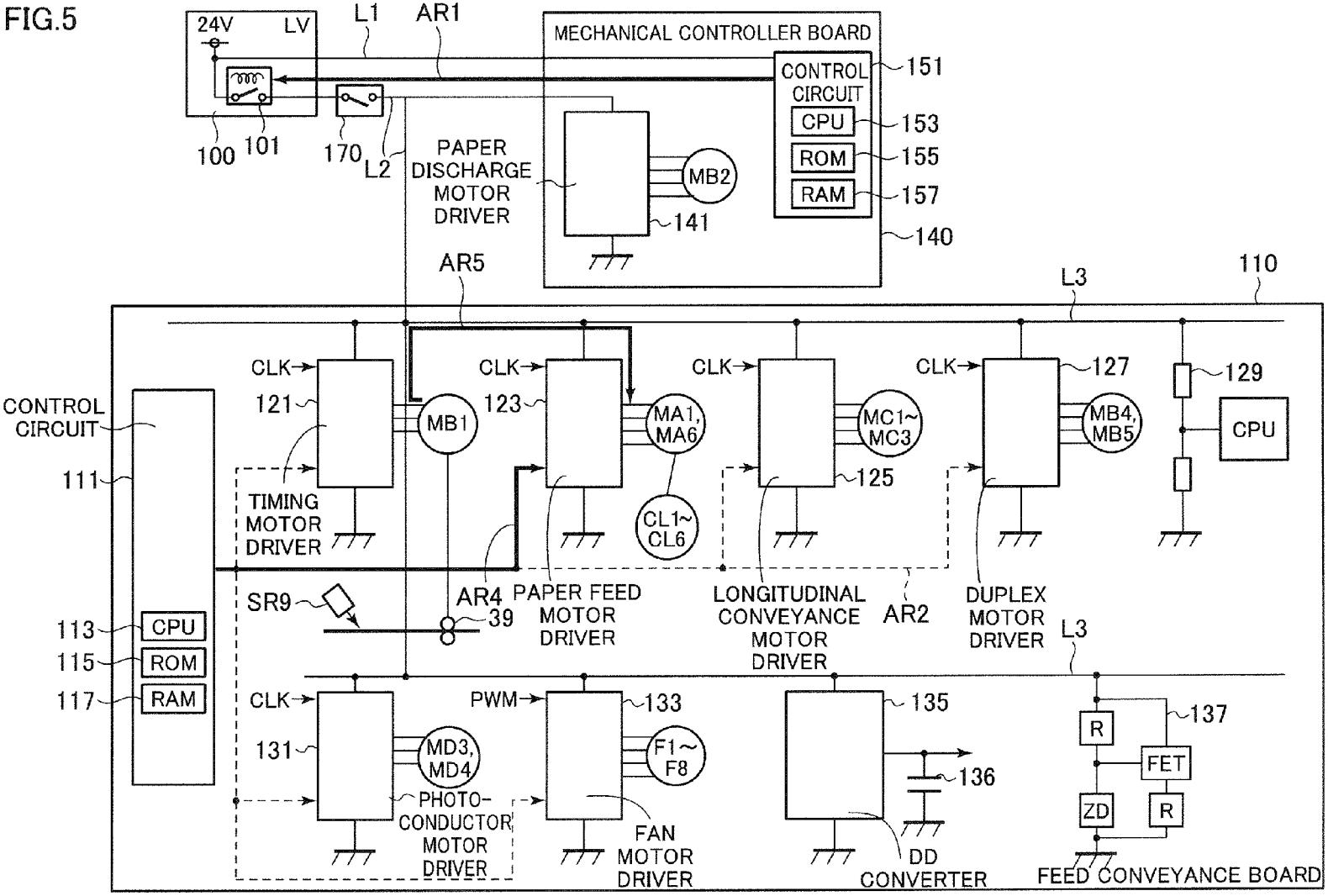
FIG. 5 is a diagram schematically illustrating operation of the image forming apparatus in an embodiment of the present invention.

FIG. 5 is a diagram schematically illustrating operation of the image forming apparatus in an embodiment of the present invention.

Referring to FIG. 5, when sensor SR9 detects occurrence of a jam, CPU 113 notifies the user of occurrence of the jam in the same manner as in the case in FIG. 4. CPU 153 of mechanical controller board 140 turns off drive relay 101. CPU 113 then selects a load from among a plurality of loads in feed conveyance board 110 connected to line L3, based on the back electromotive force measured by voltage dividing circuit 129, and controls the selected load such that regenerative power produced in motor MB1 due to the rotation of timing roller 39 is supplied to the selected load.

Specifically, CPU 113 turns on an enable signal for the selected feed conveyance load (controls the load such that it becomes operative), thereby selecting a motor to be supplied with the regenerative power. In FIG. 5, as shown by an arrow AR4, motors MA1 and MA6 are selected by turning on an enable signal for motors MA1 and MA6. As a result, as shown by an arrow AR5, regenerative power is supplied to motors MA1 and MA6.

If the possibility that the load having the minimum withstand voltage is broken becomes high over time (for example, when the increase rate of back electromotive force increases or when back electromotive force approaches the minimum withstand voltage), the loads to be supplied with regenerative power (the number of loads to be selected) may be increased. In FIG. 5, the enable signal may be further transmitted, for example, to longitudinal conveyance motor driver 125, duplex motor driver 127, photoconductor motor driver 131, or fan motor driver 133 to supply the regenerative power to motors MC1 to MC3, MB4, and MB5, MD3 and MD4, or fan motors F1 to F8, in addition to motors MA1 and MA6.

In a case where the load is a stepping motor, CPU 113 may not transmit a clock signal while turning on the enable signal for the stepping motor. Since the stepping motor does not rotate without a clock signal, in this case, the stepping motor stands still without rotating while the regenerative power is consumed by the coil of the stepping motor.

In a case where feed conveyance board 110 includes DD converter 135 and a power storage element 136, regenerative power may be supplied to power storage element 136 through DD converter 135, so that a power source different from power source 100 may be generated by power storage element 136 using the regenerative power. In a case where feed conveyance board 110 includes resistor circuit 137, regenerative power may be supplied to resistor circuit 137, so that the regenerative power is consumed (discharged) by resistor circuit 137.

[Method of Selecting Load to be Supplied with Regenerative Power]

A specific method of selecting a load to be supplied with regenerative power will now be described.

In the present embodiment, CPU 113 monitors the value of back electromotive force of regenerative power in line L3 and temporal transition of back electromotive force at the input port of the CPU of feed conveyance board 110. Accordingly, CPU 113 monitors a change of back electromotive force when the user pulls out jammed paper, and calculates the speed of pulling out the jammed paper. The speed of pulling out jammed paper corresponds to the rotational speed of the conveyance motor driving the conveyance roller where the jam occurs. CPU 113 sets a plurality of threshold values for the increase rate of back electromotive force, based on the calculated speed of pulling out. The plurality of threshold values for the increase rate of back electromotive force are set such that back electromotive force does not exceed the minimum withstand voltage of the image forming apparatus. CPU 113 calculates the increase rate of back electromotive force measured by voltage dividing circuit 129, determines the possibility that the load having the minimum withstand voltage is broken, based on the back electromotive force and the increase rate of back electromotive force, and selects a load to be supplied with regenerative power based on the determination result.

Figure 6:
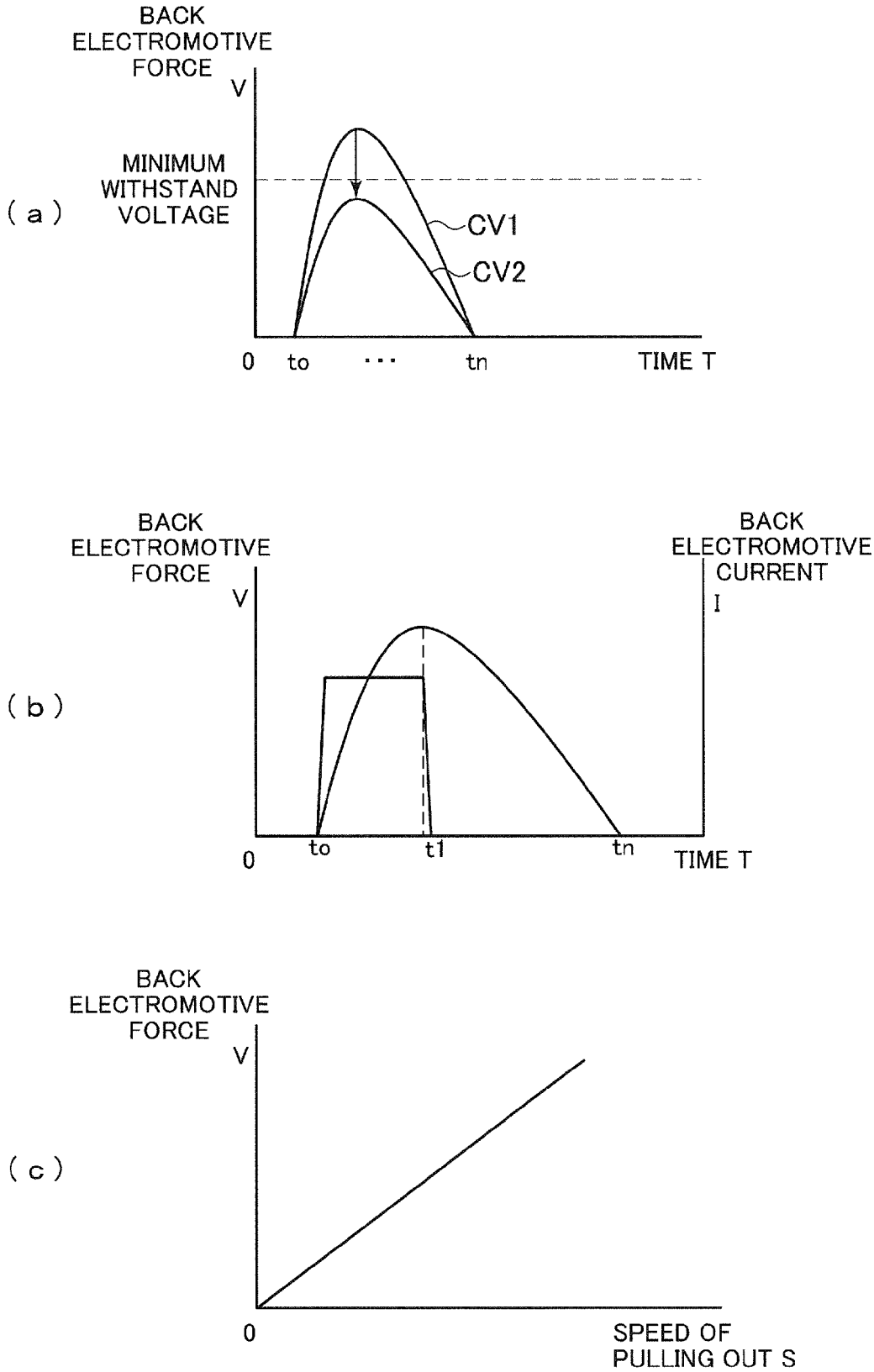
FIG. 6 is a diagram schematically showing the behavior of back electromotive force of regenerative power.

FIG. 6 is a diagram schematically showing the behavior of back electromotive force of regenerative power. In FIG. 6, (a) represents the relationship between back electromotive force and time, (b) represents the relationship between back electromotive force and back electromotive current, and time, and (c) represents the relationship between back electromotive force and the speed of pulling out jammed paper.

Referring to FIG. 6(*a*), the back electromotive force rapidly increases immediately after time t0 when measurement is started, gradually decreases after a peak, and becomes zero at time tn. If the peak value of back electromotive force exceeds the minimum withstand voltage as shown by a curve CV1, the load is broken. On the other hand, if the peak value of back electromotive force is equal to or lower than the minimum withstand voltage as shown by a curve CV2, breakage of the load is prevented. Therefore, as the increase rate ($\Delta V/\Delta T$) of back electromotive force corresponding to the inclination of a curve representing back electromotive force is greater, the possibility that back electromotive force exceeds the minimum withstand voltage is higher, and the probability that the load is broken is higher.

Referring to FIG. 6(*b*), when the motor starts rotating at time t0, back electromotive force and back electromotive current rapidly rise. The back electromotive current thereafter keeps almost a fixed value until time t1 when the back electromotive voltage reaches its peak. At time t1, the jammed paper is completely pulled out, and rotation of the motor stops. Then, the back electromotive voltage starts decreasing from the peak value, and the back electromotive current rapidly decreases.

Referring to FIG. 6(*c*), a proportional relationship holds between the back electromotive force and the speed of pulling out jammed paper. That is, the greater is the increase rate of back electromotive force, the higher is the speed of pulling out jammed paper. Therefore, the speed of pulling out jammed paper can be calculated from the value of back electromotive force.

Based on the behavior of the back electromotive force shown in FIG. 6, it is understood that the speed of pulling out jammed paper and the increase rate of back electromotive force for a period of time until back electromotive force reaches the peak (a period of time during which the increase rate of back electromotive force is equal to or greater than zero) are useful for predicting the possibility that a load having the minimum withstand voltage is broken. Therefore, CPU 113 sets a plurality of threshold values based on the speed of pulling out jammed paper for a period of time until back electromotive force reaches the peak, and determines, of a plurality of ranges set by these threshold values, which range the increase rate of back electromotive force belongs to. CPU 113 then selects a load to be supplied with regenerative power based on the determination result.

When the pulling out of jammed paper is completed (when the increase rate of back electromotive force becomes less than zero) or when consumption of regenerative power is completed (when back electromotive force becomes zero), CPU 113 may turn off the enable signal for the selected load to cut off supply of regenerative power to the selected load.

When back electromotive force of regenerative power exceeds a particular threshold value, CPU 113 may select a load to be supplied with regenerative power. When back electromotive force of regenerative power does not exceed a particular threshold value, CPU 113 may not select a load to be supplied with regenerative power and may not supply regenerative power to the other loads.

Figure 8:
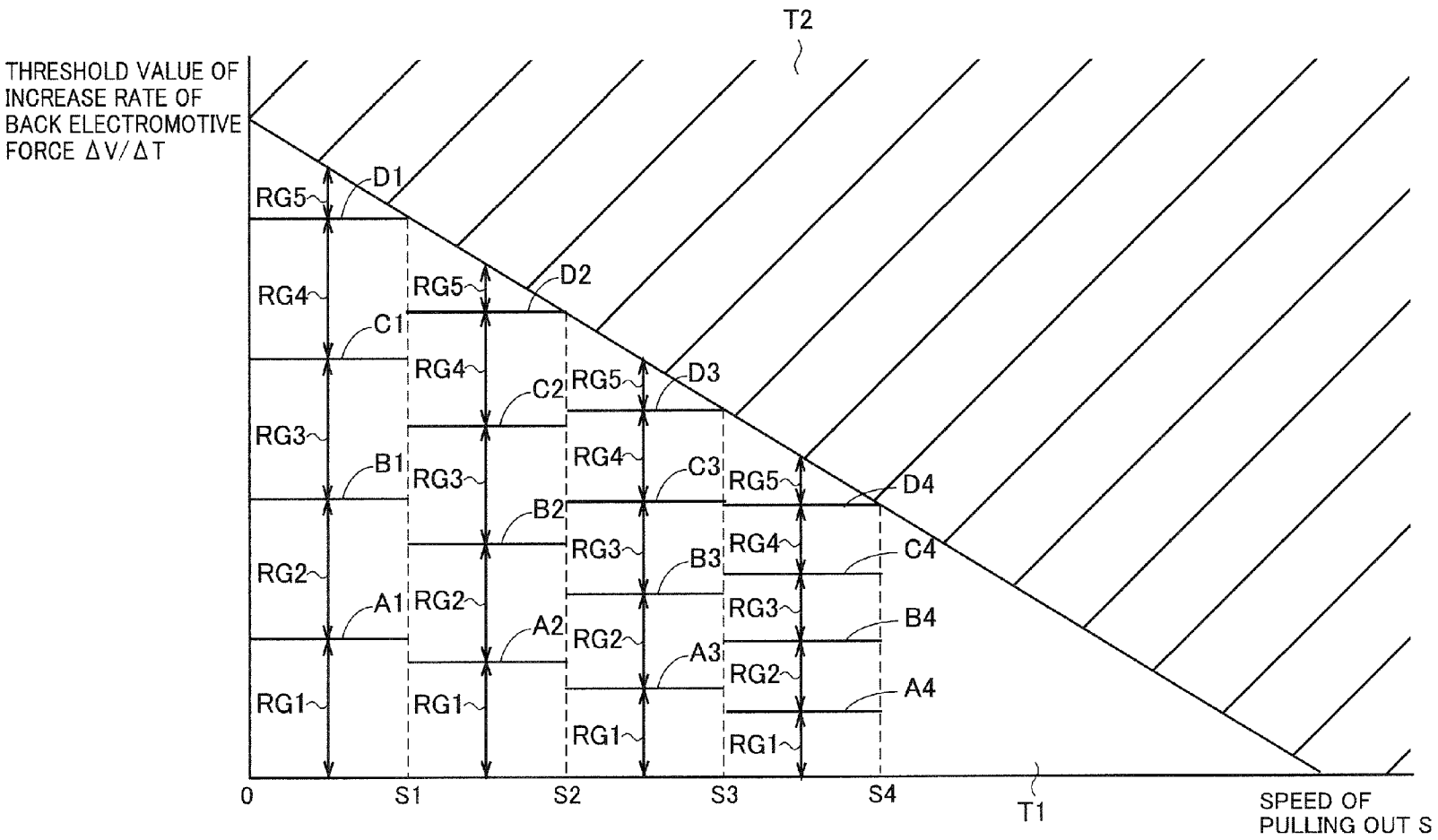
FIG. 8 is a graph showing the relationship between the possibility that a load having a minimum withstand voltage is broken and a plurality of threshold values for the increase rate of back electromotive force.

FIG. 7 is a table showing the relationship between the speed of pulling out jammed paper and a plurality of threshold values for the increase rate of back electromotive force. FIG. 8 is a graph showing the relationship between the possibility that a load having the minimum withstand voltage is broken and a plurality of threshold values for the increase rate of back electromotive force. In FIG. 7 and FIG. 8, S1, S2, S3, and S4 are threshold values for the speed of pulling out jammed paper. S1, S2, S3, and S4 have the relationship of $S1<S2<S3<S4$.

Referring to FIG. 7, four groups E1 to E4 are stored, for example, in a ROM. Groups E1 to E4 each are constituted with four threshold values for the increase rate of back electromotive force. If the speed S of pulling out jammed paper is greater than zero and equal to or smaller than S1 ($0<S\leq S1$), group E1 of threshold values for the increase rate of back electromotive force is set. Group E1 is constituted with four threshold values A1, B1, C1, and D1 ($A1<B1<C1<D1$). If the speed S of pulling out jammed paper is greater than S1 and equal to or smaller than S2 ($S1<S\leq S2$), group E2 of threshold values for the increase rate of back electromotive force is set. Group E2 is constituted with four threshold values A2, B2, C2, and D2 ($A2<B2<C2<D2$). If the speed S of pulling out jammed paper is greater than S2 and equal to or smaller than S3 ($S2<S\leq S3$), group E3 of threshold values for the increase rate of back electromotive force is set. Group E3 is constituted with four threshold values A3, B3, C3, and D3 ($A3<B3<C3<D3$). If the speed S of pulling out jammed paper is greater than S3 and equal to or smaller than S4 ($S3<S\leq S4$), group E4 of threshold values for the increase rate of back electromotive force is set. Group E4 is constituted with four threshold values A4, B4, C4, and D4 ($A4<B4<C4<D4$).

The respective smallest threshold values A1, A2, A3, and A4 in groups E1 to E4 have the relationship of $A4<A3<A2<A1$. The respective second smallest threshold values B1, B2, B3, and B4 in groups E1 to E4 have the relationship of $B4<B3<B2<B1$. The respective third smallest threshold values C1, C2, C3, and C4 in groups E1 to E4 have the relationship of $C4<C3<C2<C1$. The respective greatest threshold values D1, D2, D3, and D4 in groups E1 to E4 have the relationship of $D4<D3<D2<D1$.

In the following, the respective smallest threshold values A1, A2, A3, and A4 in groups E1 to E4 may be collectively referred to as threshold value A, the respective second smallest threshold values B1, B2, B3, and B4 in groups E1 to E4 may be collectively referred to as threshold value B, the respective third smallest threshold values C1, C2, C3, and C4 in groups E1 to E4 may be collectively referred to as threshold value C, and the respective greatest threshold values D1, D2, D3, and D4 in groups E1 to E4 may be collectively referred to as threshold value D.

Referring to FIG. 8, a region T1 is a region (safe region) where the possibility that the load having the minimum withstand voltage is broken is low, and a region T2 (the hatched region) is a region (dangerous region) where the possibility that the load having the minimum withstand voltage is broken is high. As the speed S of pulling out jammed paper is higher, back electromotive force of regenerative power approaches the value of the minimum withstand voltage, and the possibility that the load having the minimum withstand voltage is broken is higher. Therefore, the higher is the speed S of pulling out jammed paper, the smaller is the permissible range of the increase rate ($\Delta V/\Delta T$) of back electromotive force.

In each of groups E1 to E4, five ranges RG1 to RG5 for the increase rate of back electromotive force are defined by threshold values A, B, C, and D. Range RG1 is a range in which the increase rate ($\Delta V/\Delta T$) of back electromotive force is ($\Delta V/\Delta T$)≤threshold value A. Range RG2 is a range in which the increase rate ($\Delta V/\Delta T$) of back electromotive force is threshold value A<($\Delta V/\Delta T$)≤threshold value B. Range RG3 is a range in which the increase rate ($\Delta V/\Delta T$) of back electromotive force is threshold value B<($\Delta V/\Delta T$)≤threshold value C. Range RG4 is a range in which the increase rate ($\Delta V/\Delta T$) of back electromotive force is threshold value C<($\Delta V/\Delta T$)≤threshold value D. Range RG5 is a range in which the increase rate ($\Delta V/\Delta T$) of back electromotive force is threshold value D≤($\Delta V/\Delta T$).

CPU 113 determines, of the five ranges RG1 to RG5, which range the increase rate of back electromotive force belongs to, and selects a load to be supplied with regenerative power based on the determination result. In this manner, the enable signal is transmitted to the driver of the load consuming power such that the coordinates defined by the back electromotive force and the increase rate of back electromotive force fall within region T1. Accordingly, increase of back electromotive force is suppressed, and breakage of the load having the minimum withstand voltage is prevented.

FIG. 9 is a table showing the relationship between ranges to which the increase rate of back electromotive force belongs and the selected loads.

Referring to FIG. 9, all the loads in the image forming apparatus other than the load having the minimum withstand voltage (motor MB2 shown in FIG. 3) are classified into any one of four consumption groups G1, G2, G3, and G4. The priority is higher in the order of consumption group G1→consumption group G2→consumption group G3→consumption group G4. CPU 113 selects a load to be supplied with regenerative power in order starting from a load having a high priority among the priorities set for a plurality of loads.

Specifically, if the increase rate of back electromotive force belongs to range RG1 (where 0<$\Delta V/\Delta T$≤threshold value A), none of the consumption groups is selected. This is because it is predicated that if the increase rate of back electromotive force is low enough, the load having the minimum withstand voltage is not broken even without supplying regenerative power to the other loads. If the increase rate of back electromotive force belongs to range RG2 (where threshold value A<$\Delta V/\Delta T$≤threshold value B), consumption group G1 is selected as a consumption group (a group of loads to be supplied with regenerative power). If the increase rate of back electromotive force belongs to range RG3 (where threshold value B<$\Delta V/\Delta T$≤threshold value C), consumption groups G1 and G2 are selected as consumption groups. If the increase rate of back electromotive force belongs to range RG4 (where threshold value C<$\Delta V/\Delta T$≤threshold value D), consumption groups G1, G2 and G3 are selected as consumption groups. If the increase rate of back electromotive force belongs to range RG5 (where threshold value D<$\Delta V/\Delta T$), consumption groups G1, G2, G3, and G4 are selected as consumption groups.

FIG. 10 is a table schematically showing loads belonging to each of consumption groups G1 to G4.

Referring to FIG. 10, the classification of consumption groups G1 to G4 are determined considering the user's safety in a case where regenerative power is supplied to the load.

The loads included in consumption group G1 are the first-stage paper feed motor (motor MA1 shown in FIG. 2), which is a paper feed motor in the first tray, and the lift-up motor (motor MA2 shown in FIG. 2), the second-stage paper feed motor (motor MA1 shown in FIG. 2), which is the paper feed motor in the second tray, and the lift-up motor (motor MA3 shown in FIG. 2), the third-stage paper feed motor (motor MA6 shown in FIG. 2), which is the paper feed motor in the third tray, and the lift-up motor (MA4 shown in FIG. 2), and the fourth-level paper feed motor (motor MA6 shown in FIG. 2), which is the paper feed motor in the fourth tray, and the lift-up motor (motor MA5 shown in FIG. 2). The coupling of each of motors MA1 to MA6 with the roller is released by disengaging the clutch when the image forming apparatus detects a jam or when a tray is pulled out during jam handling. Therefore, the roller does not unnecessarily rotate when the user pulls out jammed paper. The user's safety is thus highest. Thus, motors MA1 to MA6 have the highest priority for supplying regenerative power.

The loads included in consumption group G2 are the timing motor (motor MB1 shown in FIG. 2), the paper discharge motor (motor MB2 shown in FIG. 2), the reverse motor (motor MB3 shown in FIG. 2), the ADU conveyance motors (motors MB4 and MB5 shown in FIG. 2), the manual paper feed motor and the lifting motor (motors MB6 and MB7 shown in FIG. 2), and the LCT motor (not shown). All of motors MB1 to MB7, which are loads included in consumption group G2, are always coupled with the rollers. However, some of the rollers driven by motors MB1 to MB7 are safe even when running (rollers at a place where the user does not access in jam handling), depending on the paper conveyance path. The paper conveyance path varies depending on the settings of the paper feed tray for supplying paper and the print mode (single-sided print or duplex print), and the place where the user does not access in jam handling also varies. The roller at a place where the user does not access poses no safety problem even when running. Thus, motors MB1 to MB7 have a high priority for supplying regenerative power.

When regenerative power is supplied to the load belonging to consumption group G2, a motor to be supplied with the regenerative power is preferably selected from among motors MB1 to MB7, depending on the settings (operation conditions) of the image forming apparatus. After the sensor detects that there exists no jammed paper, the motor driving the roller at that place may be selected.

The loads included in the consumption group G3 are the LCC intermediate motor (motor MC1 shown in FIG. 2), the longitudinal conveyance motors (motors MC2 and MC3 shown in FIG. 2), the secondary transfer roller connecting/disconnecting motor (motor MC4 in FIG. 2), and the fixing motor (motor MC5 shown in FIG. 2). All of the loads included in consumption group G3 are always coupled with the conveyance rollers in the vicinity of the doors. As shown in circle C1 in FIG. 1, when the user opens the door in jam handling, the driven roller of the conveyance roller in the vicinity of that door is separated from the driving roller of the conveyance roller. The conveyance rollers to be driven by motors MC1 to MC5 are rotated by the user's force of pulling out jammed paper when a jam occurs at those conveyance rollers. In order to prevent an accident caused by unnecessary rotation of the conveyance rollers, motors MC1 to MC5 have a low priority for supplying regenerative power.

The loads included in consumption group G4 are the clutches (clutches CL1 to CL6 shown in FIG. 2), the solenoid (solenoid SL shown in FIG. 2), the erasers (erasers EL1 to EL4 shown in FIG. 2), the power storage element (power storage element 136 shown in FIG. 3), the drive sources for the imaging system (motors MD1 to MD18 shown in FIG. 2), and the drive sources for the cooling system (fan motors F1 to F8 shown in FIG. 2). All of the loads included in consumption group G4 are non-rotating loads, and it is not preferable that they are unnecessarily driven. Therefore, those loads have the lowest priority for supplying regenerative power. A power discharge element (resistor circuit 137 shown in FIG. 3) may be included in consumption group G4.

[Flowchart Showing Operation of Image Forming Apparatus]

Figure 11:
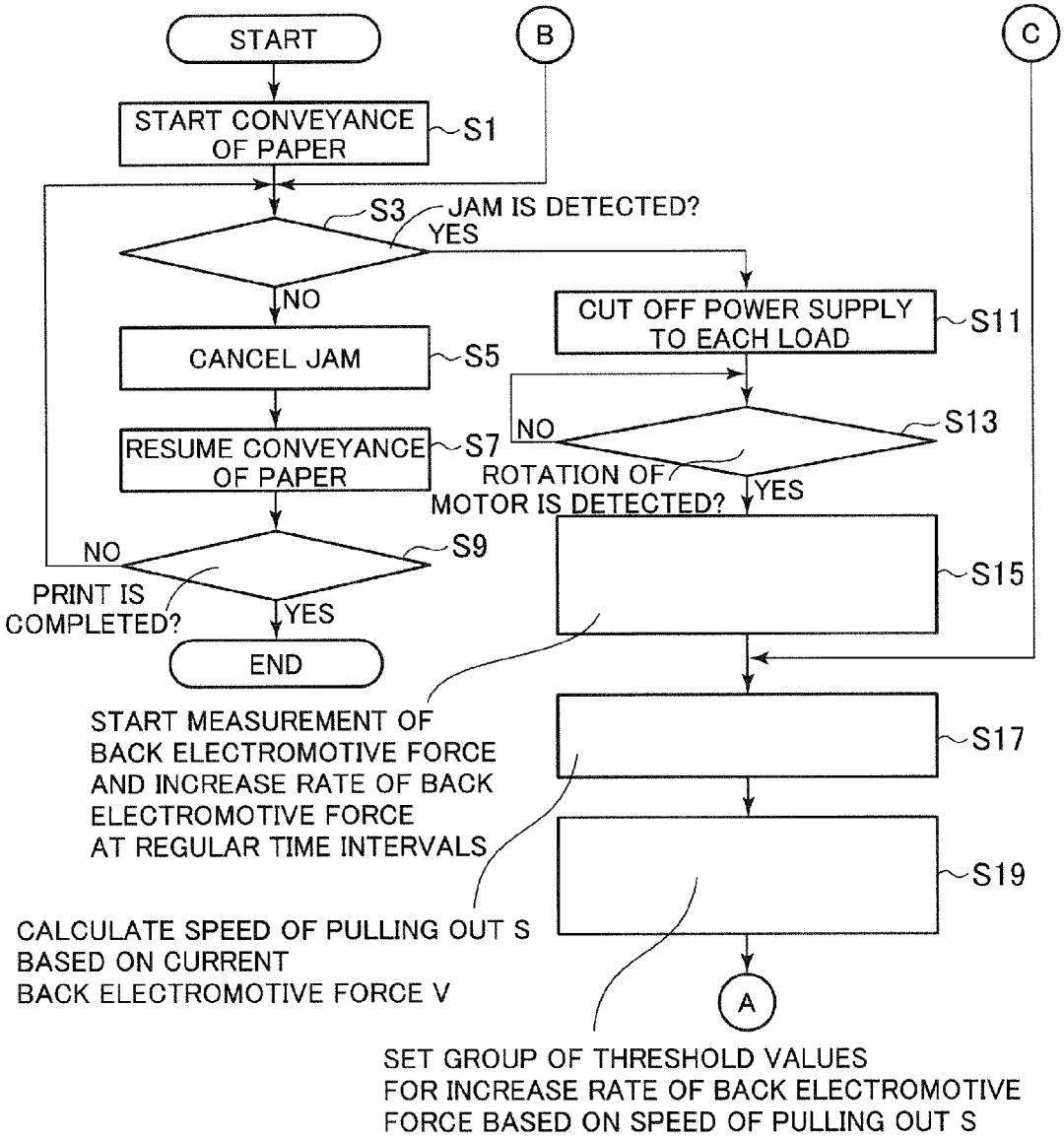
FIG. 11 is a first part of a flowchart showing operation of the image forming apparatus in an embodiment of the present invention.
Figure 12:
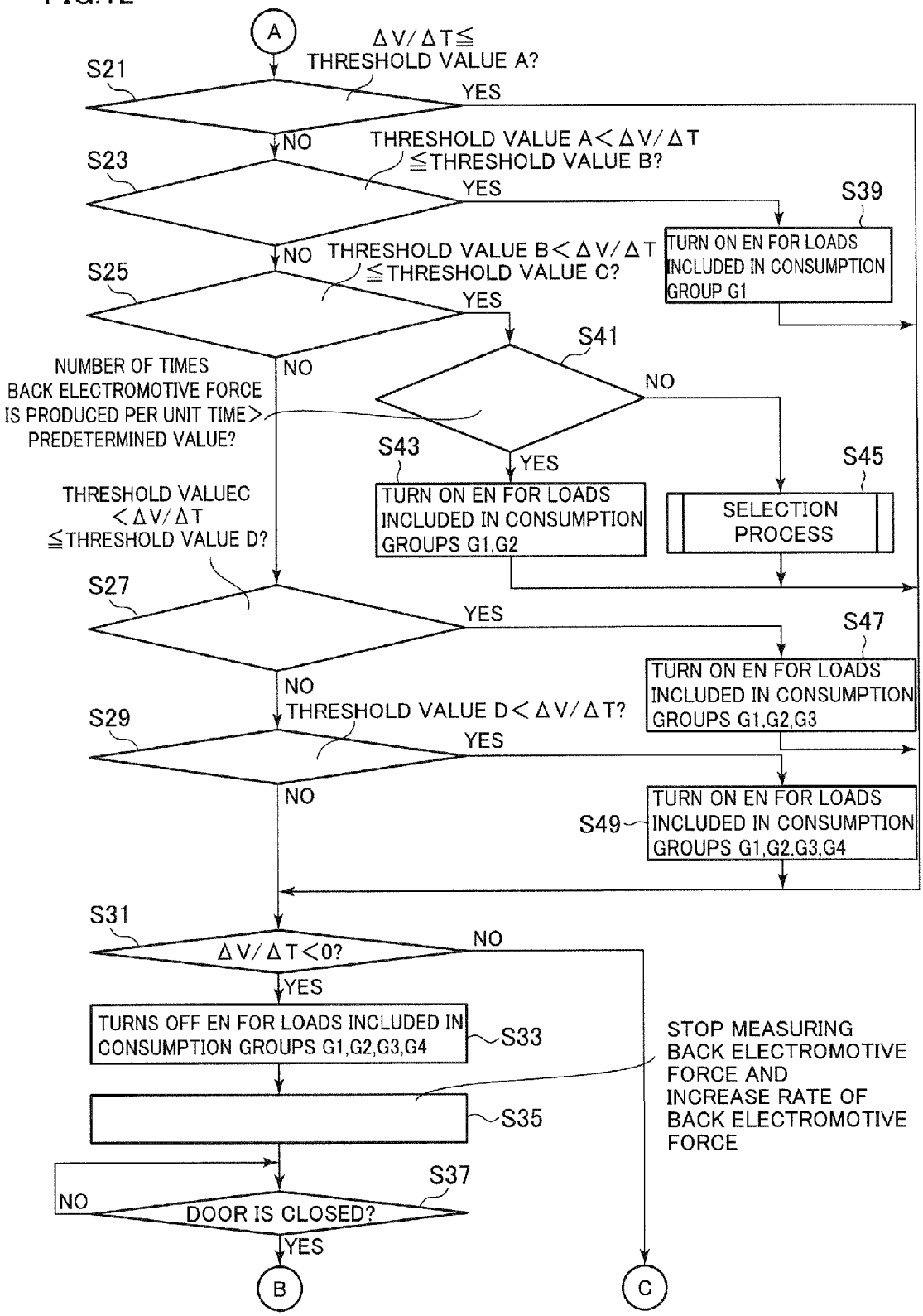
FIG. 12 is a second part of the flowchart showing operation of the image forming apparatus in an embodiment of the present invention.

FIG. 11 and FIG. 12 are flowcharts showing operation of the image forming apparatus in an embodiment of the present invention.

Referring to FIG. 11, CPU 113 of control circuit 111 starts conveyance of paper (S1) and then determines whether any one of sensors SR1 to SR13 (jam detection sensors) detects occurrence of a jam during conveyance of paper (S3).

In step S3, if it is determined that occurrence of a jam is detected (YES in S3), CPU 113 turns off drive relay 101 to cut off power supply from power source 100 to each load in image forming apparatus 1 and notifies the user of occurrence of a jam (S11).

CPU 113 then determines whether rotation of the motor driving the roller at a place where the jam occurs is detected by a sensor (S13). CPU 113 repeats the process in step S13 until rotation of the motor is detected.

In step S13, if it is determined that rotation of the motor is detected (YES in S13), CPU 113 starts measurement of back electromotive force at regular time intervals and calculates the increase rate of back electromotive force from the measured back electromotive force (S15).

After the process in step S15, CPU 113 calculates the speed of pulling out jammed paper based on the measured back electromotive force (S17). CPU 113 then sets a group of threshold values for the increase rate of back electromotive force from among groups E1 to E4, based on the speed of pulling out jammed paper (reads out threshold values A to D stored in advance) (S19) and proceeds to the process in step S21 shown in FIG. 12.

In step S3, if it is determined that occurrence of a jam is not detected (NO in S3), CPU 113 cancels the notice of occurrence of a jam if the notice is being given (S5), and resumes conveyance of paper if conveyance of paper is being halted (S7). CPU 113 then determines whether print is completed (S9).

In step S9, if it is determined that print is completed (YES in S9), CPU 113 terminates the process. On the other hand, in step S9, if it is determined that print is not completed (NO in S9), CPU 113 proceeds to the process in step S3.

Referring to FIG. 12, in step S21, CPU 113 determines whether the calculated increase rate of back electromotive force ($\Delta V/\Delta T$) falls within range RG1 (within the range greater than zero and equal to or smaller than threshold value A) (S21).

In step S21, if it is determined that the increase rate falls within range RG1 (YES in S21), CPU 113 proceeds to the process in step S31 without turning on the enable signal for the loads in feed conveyance board 110 (without supplying regenerative power to the loads).

In step S21, if it is determined that the increase rate falls out of range RG1 (NO in S21), CPU 113 determines whether the increase rate of back electromotive force falls within range RG2 (the range greater than threshold value A and equal to or smaller than threshold value B) (S23).

In step S23, if it is determined that the increase rate falls within range RG2 (YES in S23), CPU 113 turns on the enable signal (EN) for all the loads included in consumption group G1 (S39) and proceeds to the process in step S31.

In step S23, if it is determined that the increase rate falls out of range RG2 (NO in S23), CPU 113 determines whether the increase rate of back electromotive force falls within range RG3 (the range greater than threshold value B and equal to or smaller than threshold value C) (S25).

In step S25, if it is determined that the increase rate falls within range RG3 (YES in S25), CPU 113 determines whether the number of times back electromotive force is produced per unit time exceeds a predetermined value (S41).

In step S41, if it is determined that the number of times exceeds a predetermined value (YES in S41), the possibility that the load having the minimum withstand voltage is broken is relatively high. In this case, CPU 113 turns on the enable signal for all the loads included in consumption groups G1 and G2 (S43) and proceeds to the process in step S31.

In step S41, if it is determined that the number of times is equal to or smaller than a predetermined value (NO in S41), the possibility that the load having the minimum withstand voltage is broken is relatively low. In this case, CPU 113 performs a process (selection process) of selecting a load to be supplied with regenerative power from consumption group G2, considering the user's safety (S45). The selection process in step S45 will be described later. CPU 113 thereafter proceeds to the process in step S31.

In step S25, if it is determined that the increase rate falls out of range RG3 (NO in S25), CPU 113 determines whether the increase rate of back electromotive force falls within range RG4 (the range greater than threshold value C and equal to or smaller than threshold value D) (S27).

In step S27, if it is determined that the increase rate falls within range RG4 (YES in S27), CPU 113 turns on the enable signal for all the loads included in consumption groups G1, G2, and G3 (S47) and proceeds to the process in step S31.

In step S27, if it is determined that the increase rate falls out of range RG4 (NO in S27), CPU 113 determines whether the increase rate of back electromotive force falls within range RG5 (range greater than threshold value D) (S29).

In step S29, if it is determined that the increase rate falls within range RG5 (YES in S29), CPU 113 turns on the enable signal for all the loads included in consumption groups G1, G2, G3, and G4 (S49) and proceeds to the process in step S31.

In step S29, if it is determined that the increase rate falls out of range RG5 (NO in S29), CPU 113 proceeds to the process in step S31 without turning on the enable signal for the loads in feed conveyance board 110.

In step S31, CPU 113 determines whether the increase rate of back electromotive force is less than zero (S31).

In step S31, if it is determined that the increase rate is less than zero (YES in S31), the pulling out of jammed paper has been completed. In this case, CPU 113 turns off the enable signal for all the loads included in consumption groups G1, G2, G3, and G4 and controls all the loads such that they are inoperative (S33). CPU 113 then stops measuring back electromotive force and the increase rate of back electromotive force (S35). CPU 113 then determines whether all the doors of the image forming apparatus are closed, based on the detection results from door switches SW1 to SW5 (S37). CPU 113 repeats the process in step S37 until it is determined that the doors are closed.

In step S37, if it is determined that the doors are closed (YES in S37), CPU 113 proceeds to the process in step S3 shown in FIG. 11.

In step S31, if it is determined that the increase rate is equal to or greater than zero (NO in S31), the pulling out of jammed paper has not been completed. In this case, CPU 113 proceeds to the process in step S17.

Figure 13:
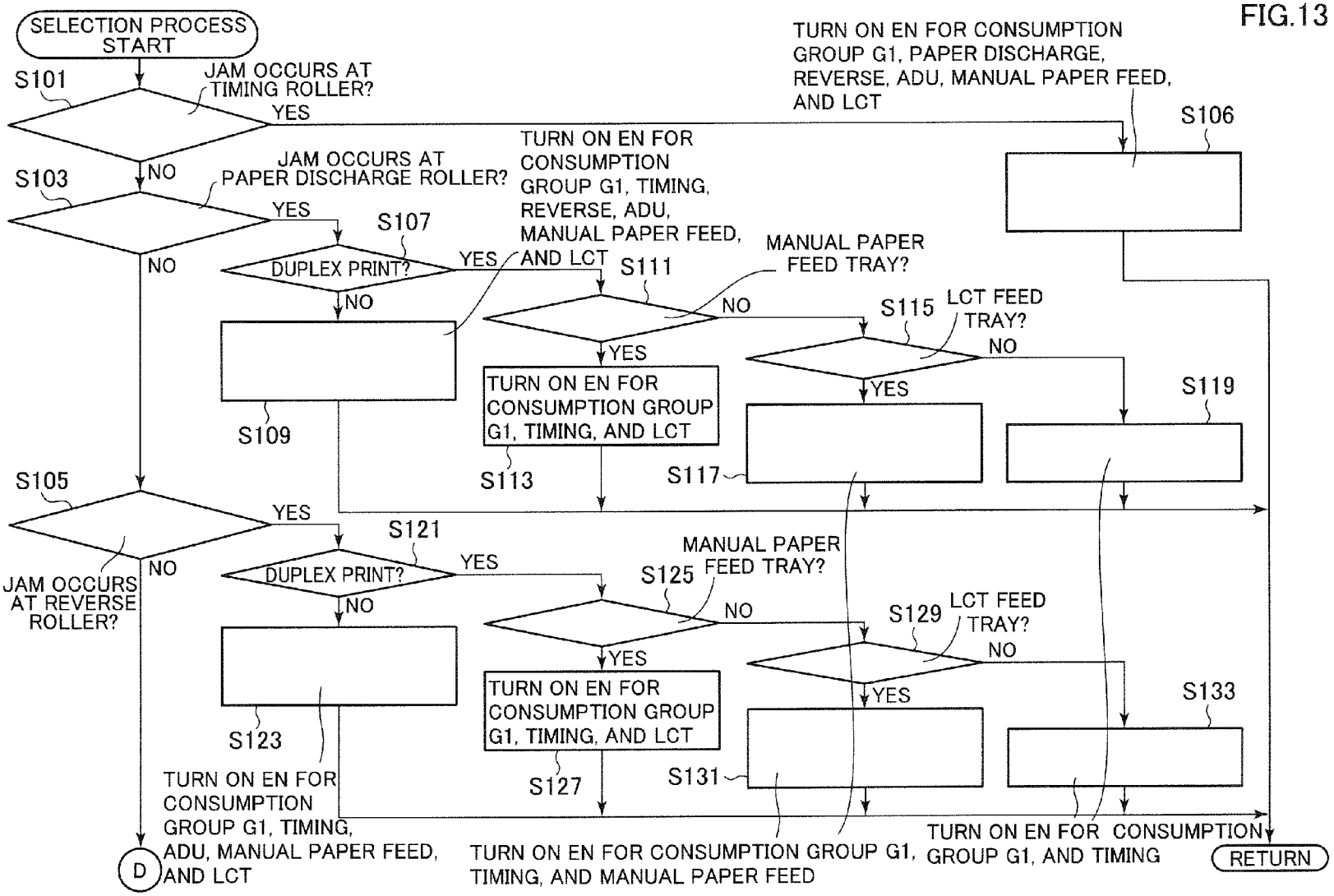
FIG. 13 is a first part of a subroutine of a selection process in step S45 in FIG. 12.
Figure 14:
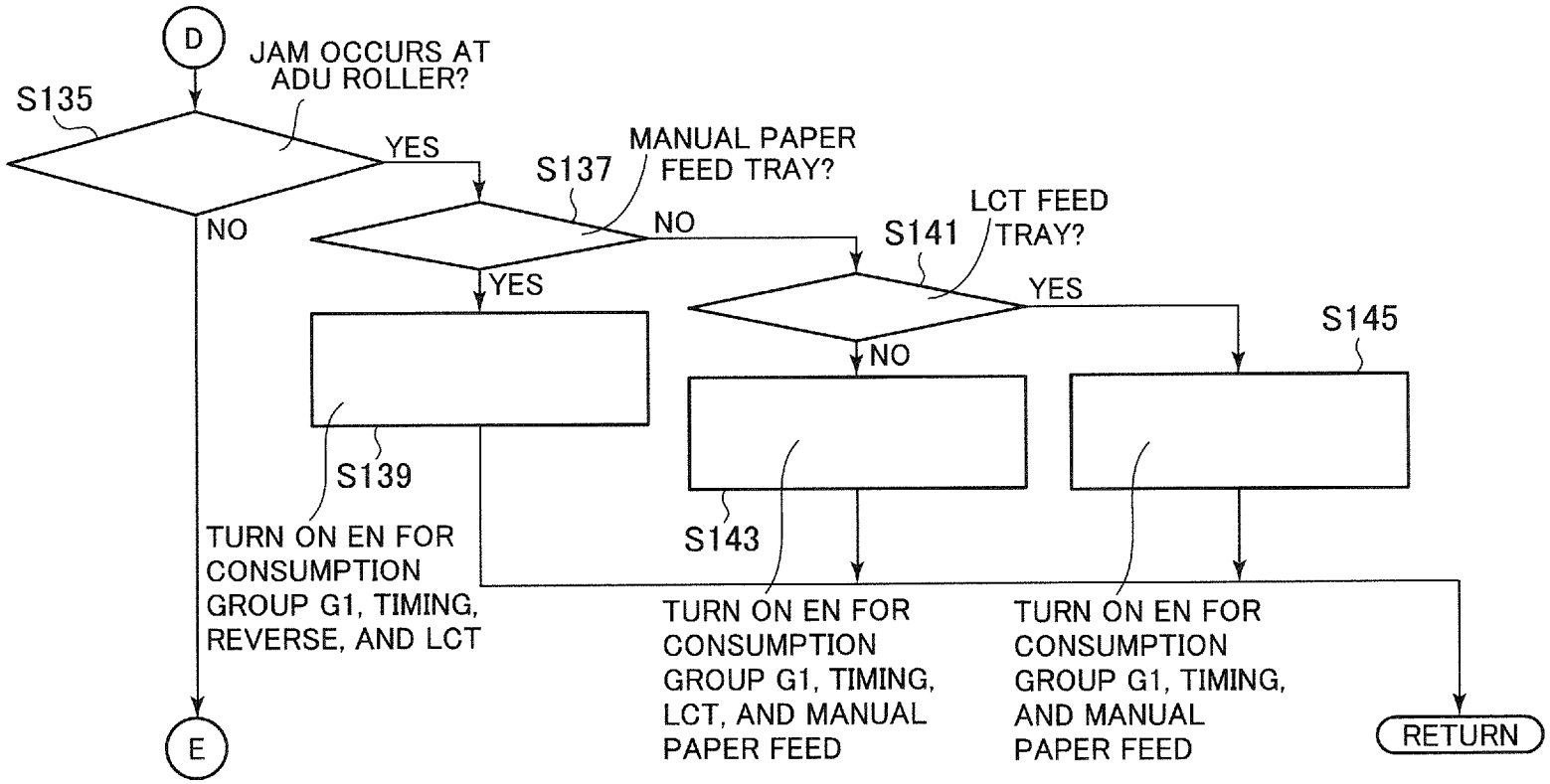
FIG. 14 is a second part of the subroutine of the selection process in step S45 in FIG. 12.
Figure 15:
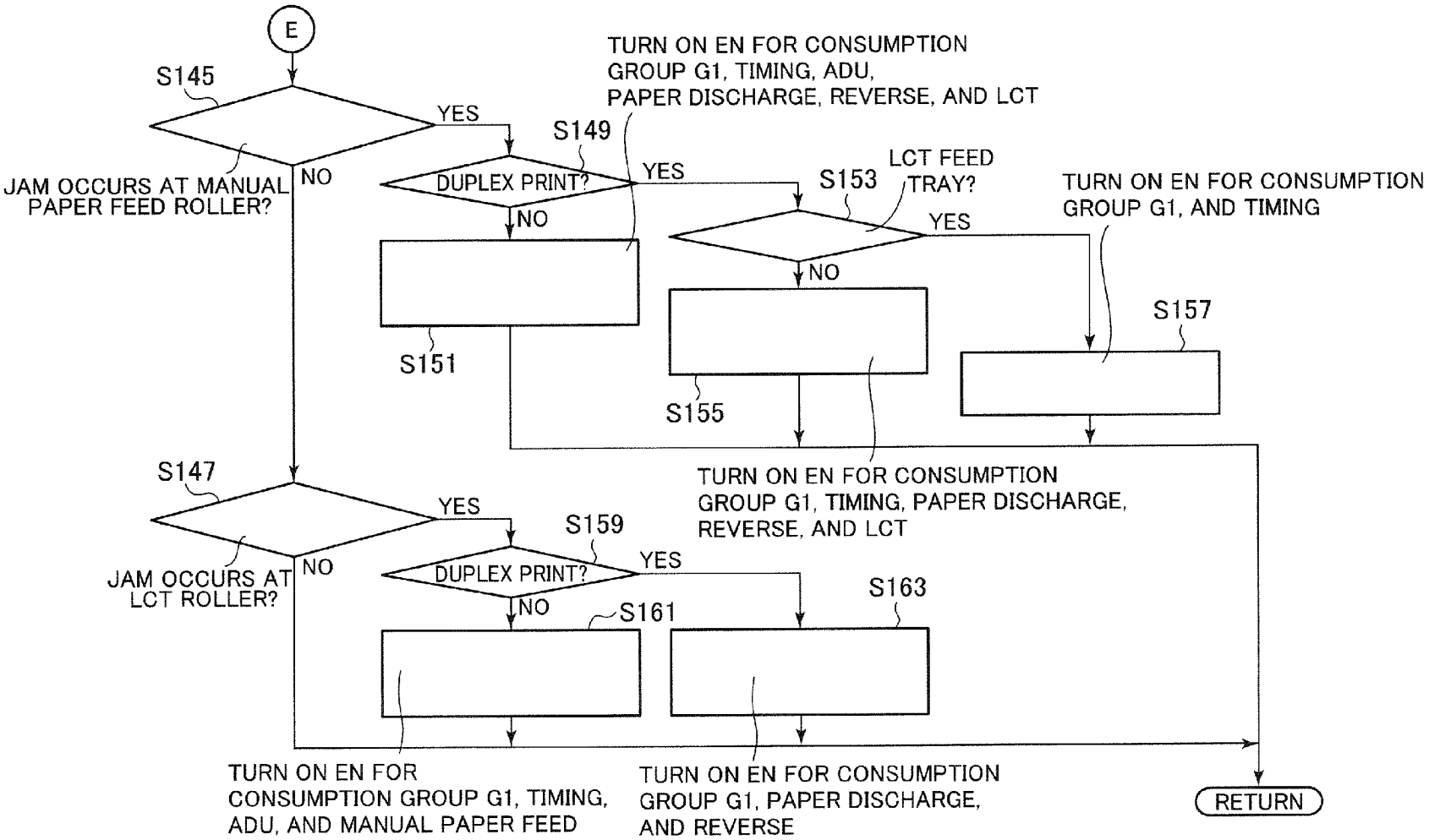
FIG. 15 is a third part of the subroutine of the selection process in step S45 in FIG. 12.

FIG. 13 to FIG. 15 show the subroutine of the selection process in step S45 in FIG. 12.

Referring to FIG. 13, in the selection process in step S45, CPU 113 determines whether the jam occurs at the timing roller (S101).

In step S101, if it is determined that the jam occurs at the timing roller (YES in S101), CPU 113 turns on the enable signal for all the loads included in consumption group G1, the paper discharge motor, the reverse motor, the ADU conveyance motor, the manual paper feed motor, the lifting motor, and the LCT motor (S106), and then returns.

In step S101, if it is determined that the jam occurs not at the timing roller (NO in S101), CPU 113 determines whether the jam occurs at the paper discharge roller (S103).

In step S103, if it is determined that the jam occurs at the paper discharge roller (YES in S103), CPU 113 determines whether the set print mode is the duplex print mode (S107).

In step S107, if it is determined the mode is not the duplex print mode (NO in S107), CPU 113 turns on the enable signal for all the loads included in consumption group G1, the timing motor, the reverse motor, the ADU conveyance motor, the manual paper feed motor, the lifting motor, and the LCT motor (S109), and then returns.

In step S107, if it is determined that the mode is the duplex print mode (YES in S107), CPU 113 determines whether the manual paper feed tray (fifth tray 25 shown in FIG. 1) is selected as a tray for supplying paper (S111).

In step S111, if it is determined that the manual paper feed tray is selected (YES in S111), CPU 113 turns on the enable signal for all the loads included in consumption group G1, the timing motor, and the LCT motor (S113) and then returns.

In step S111, if it is determined that the manual paper feed tray is not selected (NO in S111), CPU 113 determines whether the LCT tray is selected as a tray for supplying paper (S115).

In step S115, if it is determined that the LCT tray is selected (YES in S115), CPU 113 turns on the enable signal for all the loads included in consumption group G1, the timing motor, the manual paper feed motor, and the lifting motor (S117) and then returns.

In step S115, if it is determined that the LCT tray is not selected (NO in S115), CPU 113 turns on the enable signal for all the loads included in consumption group G1, and the timing motor (S119), and then returns.

In step S103, if it is determined that the jam occurs not at the paper discharge roller (NO in S103), CPU 113 determines whether the jam occurs at the reverse roller (S105).

In step S105, if it is determined that the jam occurs at the reverse roller (YES in S105), CPU 113 determines whether the set print mode is the duplex print mode (S121).

In step S121, if it is determined that the mode is not the duplex print mode (NO in S121), CPU 113 turns on the enable signal for all the loads in consumption group G1, the timing motor, the ADU conveyance motor, the manual paper feed motor, the lifting motor, and the LCT motor (S123), and then returns.

In step S121, if it is determined that the mode is the duplex print mode (YES in S121), CPU 113 determines whether the manual paper feed tray is selected as a tray for supplying paper (S125).

In step S125, if it is determined that the manual paper feed tray is selected (YES in S125), CPU 113 turns on the enable signal for all the loads included in consumption group G1, the timing motor, and the LCT motor (S127), and then returns.

In step S125, if it is determined that the manual paper feed tray is not selected (NO in S125), CPU 113 determines whether the LCT tray is selected as a tray for supplying paper (S129).

In step S129, if it is determined that the LCT tray is selected (YES in S129), CPU 113 turns on the enable signal for all the loads included in consumption group G1, the timing motor, the manual paper feed motor, and the lifting motor (S131), and then returns.

In step S129, if it is determined that the LCT tray is not selected (NO in S129), CPU 113 turns on the enable signal for all the loads included in consumption group G1 and the timing motor (S133), and then returns.

In step S105, if it is determined that the jam occurs not at the reverse roller (NO in S105), CPU 113 proceeds to the process in step S135 shown in FIG. 14.

Referring to FIG. 14, in step S135, CPU 113 determines whether the jam occurs at the ADU conveyance roller (conveyance roller 44 shown in FIG. 1) (S135).

In step S135, if it is determined that the jam occurs at the ADU conveyance roller (YES in S135), CPU 113 determines whether the manual paper feed tray is selected as a tray for supplying paper (S137).

In step S137, if it is determined that the manual paper feed tray is selected (YES in S137), CPU 113 turns on the enable signal for all the loads included in consumption group G1, the timing motor, the reverse motor, and the LCT motor (S139), and then returns.

In step S137, if it is determined that the manual paper feed tray is not selected (NO in S137), CPU 113 determines whether the LCT tray is selected as a tray for supplying paper (S141).

In step S141, if it is determined that the LCT tray is not selected (NO in S141), CPU 113 turns on the enable signal for all the loads included in consumption group G1, the timing motor, the LCT conveyance motor, the manual paper feed motor, and the lifting motor (S143), and then returns.

In step S141, if it is determined that the LCT tray is selected (YES in S141), CPU 113 turns on the enable signal for all the loads included in consumption group G1, the timing motor, the manual paper feed motor, and the lifting motor (S145), and then returns.

In step S135, if it is determined that the jam occurs not at the ADU conveyance roller (NO in S135), CPU 113 proceeds to the process in step S145 shown in FIG. 15.

Referring to FIG. 15, in step S145, CPU 113 determines whether the jam occurs at the manual paper feed roller (paper feed roller 35 shown in FIG. 1) (S145).

In step S145, if it is determined that the jam occurs at the manual paper feed roller (YES in S145), CPU 113 determines whether the set print mode is the duplex print mode (S149).

In step S149, if it is determined that the mode is not the duplex print mode (NO in S149), CPU 113 turns on the enable signal for all the loads included in consumption group G1, the timing motor, the ADU conveyance motor, the paper discharge motor, the reverse motor, and the LCT motor (S151), and then returns.

In step S149, if it is determined that the mode is the duplex print mode (YES in S149), CPU 113 determines whether the LCT tray is selected as a tray for supplying paper (S153).

In step S153, if it is determined that the LCT tray is not selected (NO in S153), CPU 113 turns on the enable signal for all the loads included in consumption group G1, the timing motor, the paper discharge motor, and the LCT motor (S155), and then returns.

In step S153, if it is determined that the LCT tray is selected (YES in S153), CPU 113 turns on the enable signal for all the loads included in consumption group G1 and the timing motor (S157), and then returns.

In step S145, if it is determined that the jam occurs not at the manual paper feed roller (NO in S145), CPU 113 determines whether the jam occurs at the LCT roller (S147).

In step S147, if it is determined that the jam occurs at the LCT roller (YES in S145), CPU 113 determines whether the set print mode is the duplex print mode (S159).

In step S159, if it is determined that the mode is not the duplex print mode (NO in S159), CPU 113 turns on the enable signal for all the loads included in consumption group G1, the timing motor, the ADU conveyance motor, the manual paper feed motor, and the lifting motor (S161), and then returns.

In step S159, if it is determined that the mode is the duplex print mode (YES in S159), CPU 113 turns on the enable signal for all the loads included in consumption group G1, the timing motor, the paper discharge motor, and the reverse motor (S163), and then returns.

In step S147, if it is determined that the jam occurs not at the LCT roller (NO in S147), CPU 113 returns.

[Modified Method of Selecting Load to be Supplied with Regenerative Power]

The image forming apparatus may select a load not based on the increase rate of back electromotive force but based on only the magnitude of back electromotive force and may control the operating state of the selected load such that regenerative power is supplied to the selected load.

FIG. 16 is a table showing the relationship between the magnitude of back electromotive force and the selected load in a modified method of selecting a load to be supplied with regenerative power.

Referring to FIG. 16, CPU 113 selects loads to be supplied with regenerative power in order starting from a load having a high priority among the priorities set for a plurality of loads, based on the magnitude of back electromotive force.

Specifically, if back electromotive force (V) belongs to range RG1 (where $0<V<$threshold value V1), none of the consumption groups is selected. This is because it is predicted that if the increase rate of back electromotive force is low enough, the load having the minimum withstand voltage is not broken even without supplying regenerative power to the other loads. If the increase rate of back electromotive force belongs to range RG2 (where threshold value V1$<V\leq$threshold value V2), consumption group G1 is selected as a consumption group. If the increase rate of back electromotive force belongs to range RG3 (where threshold value V2$<V\leq$threshold value V3), consumption groups G1 and G2 are selected as consumption groups. If the increase rate of back electromotive force belongs to range RG4 (where threshold value V3$<V\leq$threshold value V4), consumption groups G1, G2, and G3 are selected as consumption groups. If the increase rate of back electromotive force belongs to range RG5 (threshold value V4$<V$), consumption groups G1, G2, G3, and G4 are selected as consumption groups.

Effects of Embodiment

The present embodiment provides an image forming apparatus capable of properly protecting loads in the image forming apparatus.

According to the present embodiment, when regenerative power is produced due to jam handling, the image forming apparatus turns on the enable signal for loads (drive sources, devices, coils) other than the load having the minimum withstand voltage to render the driver between the loads conductive, thereby consuming regenerative power. Accordingly, the load producing regenerative power and the other loads connected to the same power supply system as the load producing regenerative power in the image forming apparatus can be protected from regenerative power while ensuring the user's safety. Since the protection from regenerative power is provided only by software control, increase in manufacturing cost of the image forming apparatus can be suppressed.

The present embodiment allows an appropriate load to consume regenerative power in accordance with back electromotive force because the load to be supplied with regenerative power is selected based on the back electromotive force of regenerative power. In particular, the load to consume regenerative power is automatically selected based on conditions including whether the load is coupled to the roller, where the jam occurs, and the set print mode, so that the load to be supplied with regenerative power can be selected considering the user's safety and convenience.

[Others]

When regenerative power is produced, the image forming apparatus may select a load to be supplied with regenerative power not based on back electromotive force but based on the settings such as the paper feed tray for supplying paper and the print mode (single-sided print or duplex print).

When regenerative power is produced, the image forming apparatus may control the operating state of a particular load such that regenerative power is always supplied only to a particular load (for example, motors MA1 and MA4 shown in FIG. 3), not based on back electromotive force.

The foregoing embodiments can be combined as appropriate. For example, the configuration of the modification of selecting a load only based on the magnitude of back electromotive force may be combined with a configuration in which supply of regenerative power to a load is cut off when the pulling out of paper that causes a jam is completed or when consumption of the regenerative power is completed.

The processing in the foregoing embodiments may be performed either by software or by a hardware circuit. A program for executing the processing in the foregoing embodiments may be provided. A recording medium, such as a CD-ROM, a flexible-disk, a hard disk, a ROM, a RAM, or a memory card, encoded with the program may be provided to users. The program may be downloaded to the apparatus through a communication circuit such as the Internet.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

a plurality of loads receiving supply of electric power from a power source;

a conveyance roller for conveying paper;

a first load that is one of the plurality of loads for driving the conveyance roller;

a second load that is one of the plurality of loads and different from the first load;

a jam detector for detecting whether a jam occurs at the conveyance roller;

a first power cut-off unit for cutting off supply of electric power from the power source to the plurality of loads, if the jam detector detects occurrence of a jam; and a power supply unit for controlling an operating state of the second load such that regenerative power produced at the first load due to rotation of the conveyance roller is supplied to the second load, if the jam detector detects occurrence of a jam.

2. The image forming apparatus according to claim 1, further comprising:

a measurement unit for measuring back electromotive force that is electromotive force of the regenerative power; and a selector for selecting a load to be supplied with the regenerative power as the second load among from the plurality of loads, based on the back electromotive force measured by the measurement unit.

3. The image forming apparatus according to claim 2, wherein the selector selects the second load in order starting from a load having a high priority among priorities set for the plurality of loads.

4. The image forming apparatus according to claim 3, wherein the plurality of loads includes first and second motors, and the priority by which the selector selects the first motor in a state in which coupling with a roller is released is higher than the priority by which the selector selects the second motor in a state in which coupling with a roller is not released.

5. The image forming apparatus according to claim 4, wherein the plurality of loads further include a non-rotating load, and the priority by which the selector selects the second motor in a state in which coupling with a roller is not released is higher than the priority by which the selector selects the non-rotating load.

6. The image forming apparatus according to claim 5, wherein the non-rotating load includes at least one of a clutch, a solenoid, an eraser, a power storage element, a power discharge element, a drive source for an imaging system, and a drive source for a cooling system.

7. The image forming apparatus according to claim 2, further comprising:

a rotational speed calculation unit for calculating a rotational speed of a conveyance motor that is the first load, based on the back electromotive force measured by the measurement unit;

a threshold setting unit for setting a plurality of threshold values for an increase rate of back electromotive force, based on the rotational speed calculated by the rotational speed calculation unit;

an increase rate calculation unit for calculating an increase rate of the back electromotive force measured by the measurement unit; and a range determination unit for determining, of a plurality of ranges defined by the plurality of threshold values set by the threshold setting unit, which range the increase rate calculated by the increase rate calculation unit falls in, wherein the selector selects the second load based on a determination result by the range determination unit.

8. The imaging forming apparatus according to claim 1, wherein if the jam detector detects occurrence of a jam, when back electromotive force of the regenerative power exceeds a particular threshold value, the power supply unit controls an operating state of the second load such that the regenerative power produced due to rotation of the conveyance roller is supplied to the second load.

9. The imaging forming apparatus according to claim 1, wherein if the jam detector detects occurrence of a jam, the power supply unit controls an operating state of the second load such that the regenerative power is always supplied only to a particular second load, irrespective of back electromotive force of the regenerative power.

10. The image forming apparatus according to claim 1, further comprising a second power cut-off unit for cutting off supply of the regenerative power to the second load if pulling out of paper that causes a jam is completed or if consumption of the regenerative power is completed, after the power supply unit allows the regenerative power to be supplied to the second load.

11. The image forming apparatus according to claim 1, further comprising:

a drive relay for switching whether to supply electric power from the power source to the plurality of loads; and a driver for controlling the second load based on a control signal, wherein the first power cut-off unit cuts off supply of electric power to the plurality of loads by turning off the drive relay, and the power supply unit transmits a control signal to the driver to bring the second load into an operative state.

12. A method of controlling an image forming apparatus including a plurality of loads receiving supply of electric power from a power source, a conveyance roller for conveying paper, a first load that is one of the plurality of loads for driving the conveyance roller, and a second load that is one of the plurality of loads and different from the first load, comprising:

detecting whether a jam occurs at the conveyance roller;

if occurrence of a jam is detected, cutting off supply of electric power from the power source to the plurality of loads; and if occurrence of a jam is detected, controlling an operating state of the second load such that regenerative power produced at the first load due to rotation of the conveyance roller is supplied to the second load.

* * * * *